US008797240B2

(12) United States Patent
Kishi

(10) Patent No.: US 8,797,240 B2
(45) Date of Patent: Aug. 5, 2014

(54) DISPLAY DEVICE AND METHOD FOR DRIVING DISPLAY DEVICE

(75) Inventor: Noritaka Kishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 178 days.

(21) Appl. No.: 13/515,491

(22) PCT Filed: Dec. 13, 2010

(86) PCT No.: PCT/JP2010/072390

§ 371 (c)(1),
(2), (4) Date: Jun. 12, 2012

(87) PCT Pub. No.: WO2011/074540

PCT Pub. Date: Jun. 23, 2011

(65) Prior Publication Data

US 2012/0249513 A1 Oct. 4, 2012

(30) Foreign Application Priority Data

Dec. 14, 2009 (JP) ..... 2009-283223

(51) Int. Cl.
*G09G 3/30* (2006.01)
*G09G 3/36* (2006.01)

(52) U.S. Cl.
USPC ..... 345/76; 345/92

(58) Field of Classification Search
USPC ..... 345/76, 82, 92
See application file for complete search history.

(56) References Cited

U.S. PATENT DOCUMENTS 8,115,705 B2 * 2/2012 Kawabe ..... 345/76
8,207,916 B2 * 6/2012 Osame et al. ..... 345/76
8,237,637 B2 * 8/2012 Chung ..... 345/76
2007/0126665 A1 6/2007 Kimura
2009/0219234 A1 9/2009 Yamamoto et al.

FOREIGN PATENT DOCUMENTS

JP 2006-215275 A 8/2006
JP 2007-108380 A 4/2007
JP 2007-179042 A 7/2007
JP 2007-316453 A 12/2007
JP 2009-204881 A 9/2009

OTHER PUBLICATIONS

International Search Report received for PCT Patent Application No. PCT/JP2010/072390, mailed on Jan. 11, 2011, 8 pages (4 pages of English translation and 4 pages of PCT Search Report).

* cited by examiner

*Primary Examiner* — Kevin M Nguyen
(74) *Attorney, Agent, or Firm* — Morrison & Foerster LLP

(57) ABSTRACT

A display device including: pixels, each provided with first to fourth transistors, a light-emitting element, a control terminal of the fourth transistors is connected to a scanning line, a second electrically-conductive terminal of the second transistor, a first electrically-conductive terminal of the third transistor, a control terminal of the third transistor are connected to each other; and a second control line (AZC) shared commonly by at least two pixels. The at least two pixels being such that the fourth transistors of the at least two pixels are connected to different scanning lines, and second electrically-conductive terminals of the third transistors of the at least two pixels are connected to the second control line, the at least two pixels being such that the third transistors of the at least two pixels are concurrently turned ON, after the first transistors of the at least two pixels are sequentially turned OFF.

19 Claims, 16 Drawing Sheets

DISPLAY DEVICE AND METHOD FOR DRIVING DISPLAY DEVICE

CROSS REFERENCE TO RELATED APPLICATIONS

This is a U.S. National Phase patent application of PCT/JP2010/072390, filed Dec. 13, 2010, which claims priority to Japanese Patent Application No. 2009-283223, filed Dec. 14, 2009, each of which is hereby incorporated by reference in the present disclosure in its entirety.

TECHNICAL FIELD

The present invention relates to a display device including a light-emitting element (for example, an organic EL element).

BACKGROUND ART

A patent literature 1 discloses a display device including organic EL elements (see FIG. 16). This conventional display device includes (i) control lines DSL, AZL1, AZL2, and WSL, (ii) signal lines DTL, and (iii) power supply lines Vofs, Vss, Vcc, and Vcat. In the display device, an organic EL element 1, five n-channel transistors T1 through T5, and a capacitor C1 are provided in each pixel 10. Note, here, that (i) a gate terminal of the transistor T1 is connected to the control line WSL, (ii) a gate terminal of the transistor T2 is connected to the control line AZL2, (iii) a gate terminal of the transistor T3 is connected to the control line DSL, (iv) a gate terminal of the transistor T4 is connected to the control line AZL1, (v) a gate terminal of the transistor T5 (drive transistor) is connected to the signal line DTL via the transistor T1 and to the power supply line Vofs via the transistor T2, (vi) a drain terminal of the transistor T5 is connected to Vcc via the transistor T3, (vii) a source terminal of the transistor T5 is connected to an anode of an organic EL element and to Vss via the transistor T4, (viii) the capacitor C1 is provided between a gate terminal and a source terminal of the transistor T5, and (ix) a cathode of the organic EL element is connected to the power supply line Vcat.

The pixel circuit 10 is arranged in which (i) an anode electric potential of the organic EL element 1 is subjected to initialization and a threshold value of the transistor T5 is detected (the threshold value of the transistor T5 is stored between the gate terminal and the source terminal of the transistor T5), and (ii) a data signal electric potential is written into the gate terminal of the transistor T5 via the transistor T1 so that a current flows through the organic EL element 1 via the transistors T3 and T5 (so that the organic EL element 1 emits light). This arrangement can correct a possible increase in resistance caused by the threshold value of the transistor T5 and deterioration of the organic EL element.

The patent literature 1 discloses an arrangement that one wiring line is used so as to serve as both the power supply line Vofs connected to the transistor T2 and the control line WSL. A patent literature 2 discloses an arrangement that one wiring line is used to serve as both a control line AZL2 of a given horizontal pixel row and a control line WSL of another horizontal pixel row followed by the given horizontal pixel row. A patent literature 3 discloses an arrangement that one wiring line is used so as to serve as both a power supply line Vss connected to a transistor T4 and a power supply line Vofs connected to a transistor T2, and an electric potential that is being supplied via the signal line during each period is switched from one to another.

CITATION LIST

Patent Literature

Patent Literature 1

Japanese Patent Application Publication, Tokukai, No. 2006-215275 A (Publication Date: Aug. 17, 2006)

Patent Literature 2

Japanese Patent Application Publication, Tokukai, No. 2007-316453 A (Publication Date: Dec. 6, 2007)

Patent Literature 3

Japanese Patent Application Publication, Tokukai, No. 2007-108380 A (Publication Date: Apr. 26, 2007)

SUMMARY OF INVENTION

Technical Problem

However, in the display device shown in FIG. 16, it is necessary that the control lines AZ1, AZ2, and DSL, which are provided for each horizontal pixel row, be independently driven. This gives rise to a problem that a driver circuit arrangement becomes complex. A circuit driver with the complex arrangement is difficult to be mounted. Further, drawing around of these lines in the circuit driver is increased.

An object of the present invention is to provide a display device including light-emitting elements, the display device being arranged in which the number of control lines necessary to be independently driven is reduced so that mounting of driver circuits becomes easier and drawing around of wiring lines is required less.

Solution to Problem

A display device of the present invention includes: pixels, each of which is provided with first to fourth transistors, and a light-emitting element, each pixel being configured such that a control terminal of the first transistor is connected to a first control line, a control terminal of the fourth transistor is connected to a scanning line, a first electrically-conductive terminal of the fourth transistor is connected to a data line, a first electrically-conductive terminal of the second transistor is connected to a first power supply line via the first transistor, a control terminal of the second transistor is connected to the data line via the fourth transistor and to a terminal of the light-emitting element via a capacitor, the terminal of the light-emitting element, a second electrically-conductive terminal of the second transistor, a first electrically-conductive terminal of the third transistor, and a control terminal of the third transistor are connected to each other; and a second control line shared commonly by at least two pixels among the pixels, the at least two pixels being such that the fourth transistors of the at least two pixels are connected to different scanning lines, and second electrically-conductive terminals of the third transistors of the at least two pixels are connected to the second control line, the at least two pixels being such that the third transistors of the at least two pixels are concurrently turned ON, after the first transistors of the at least two pixels are sequentially turned OFF.

In the display device, lighting periods in horizontal pixel rows (that is, pixels) can be set to same timings and each second control line can be shared commonly by two or more horizontal pixel rows. This makes it possible that required number of second control lines necessary to be independently driven (and required number of outputs for the respective second control lines) is decreased to fewer than that in a conventional arrangement (see FIG. 16), and driver circuits are simplified in configuration and decreased in size. This can make mounting of the driver circuits easier and requires less drawing around of wiring lines, so that improved productivity can be achieved.

A display device of the present invention includes: pixels, each of which is provided with first to fourth transistors, and a light-emitting element, each pixel being configured so that a control terminal of the first transistor is connected to a first control line, a control terminal of the fourth transistor is connected to a scanning line, a first electrically-conductive terminal of the fourth transistor is connected to a data line, a first electrically-conductive terminal of the second transistor is connected to a first power supply line via the first transistor, a first electrically-conductive terminal of the third transistor is connected to an initialization electric potential supply line, a control terminal of the second transistor is connected to the data line via the fourth transistor and to a terminal of the light-emitting element via a capacitor, and the terminal of the light-emitting element, a second electrically-conductive terminal of the second transistor, and a second electrically-conductive terminal of the third transistor are connected to one other; and a second control line shared commonly by at least two pixels among the pixels, the at least two pixels being such that the fourth transistors of the at least two pixels are connected to different scanning lines, and control terminals of the third transistors of the at least two pixels are connected to the second control line, the at least two pixels being such that the third transistors of the at least two pixels are concurrently turned ON, after the first transistors of the at least two pixels are sequentially turned OFF.

In the display device of the present invention, lighting periods of pixels of different horizontal pixel rows can set to same timings and each second control line can be shared commonly by two or more horizontal pixel rows. This makes it possible that the number of second control lines necessary to be independently driven (and the number of outputs for respective second control lines) is decreased to less than that in a conventional arrangement, and driver circuits are simplified in configuration and reduced in size. This can make mounting of the driver circuits easier and requires less drawing around of wiring lines, so that an increased productivity can be achieved.

Advantageous Effects of Invention

In the present invention, a display device including a light-emitting element is arranged so that (i) the number of second control lines necessary to be independently driven (and the number of outputs for respective second control lines) is decreased and (ii) driver circuits are simplified in configuration and reduced in size. This can make mounting of the driver circuits easier and requires less drawing around of lines. This can achieve an improved productivity.

DESCRIPTION OF EMBODIMENTS

Embodiments of the present invention are described below with reference to FIGS. 1 through 15.

Embodiment 1

Figure 1:
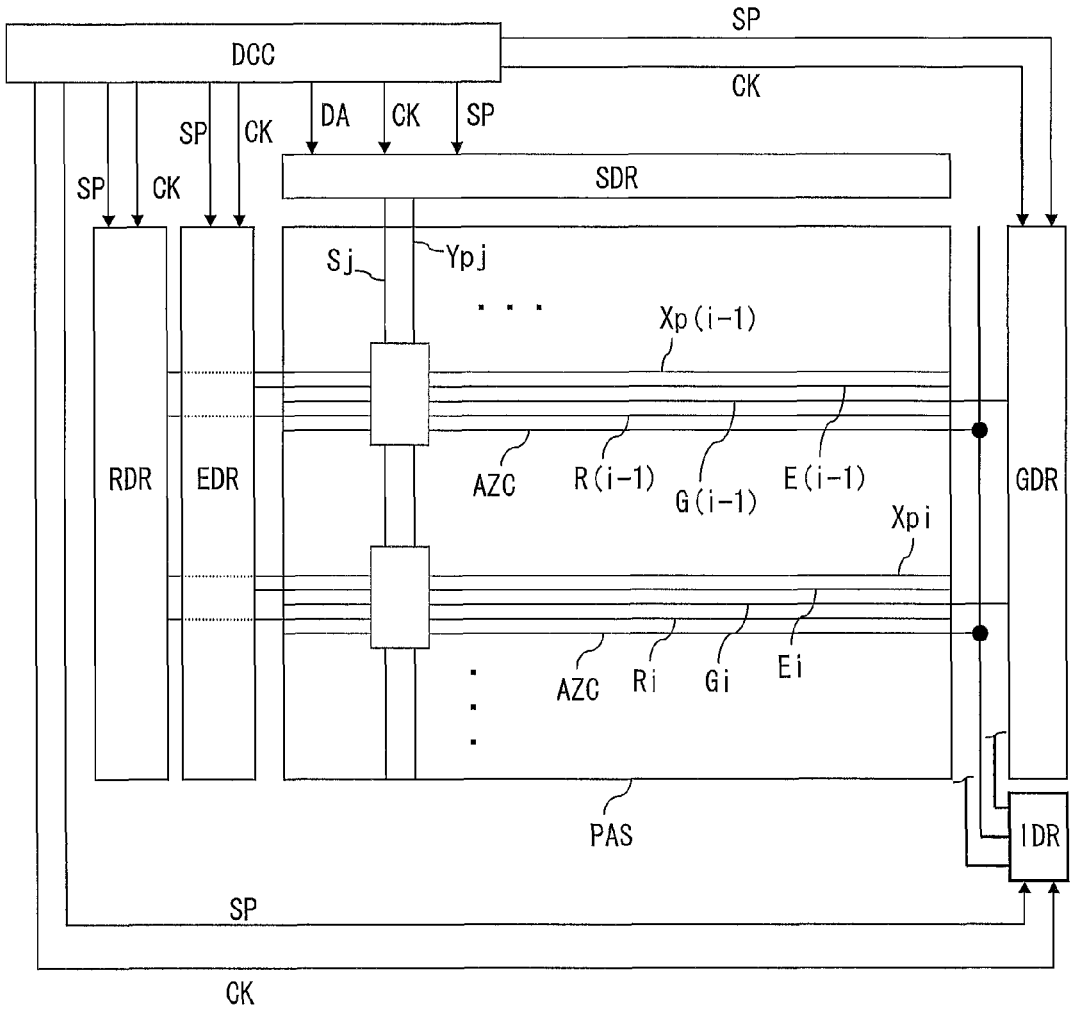
FIG. 1 is a view schematically showing how a present display device is arranged in accordance with Embodiment 1.

FIG. 1 is a block view showing how a display device is configured in accordance with Embodiment 1. As shown in FIG. 1, the display device includes a pixel array substrate PAS, a display control circuit DCC, a light-emitting driver EDR, a gate driver GDR, a correction driver RDR, an initialization driver IDR, and a source driver SDR. The pixel array substrate PAS includes wiring lines in which, for example, (i) a first power supply line Ypj and a data line Sj are provided for a $j^{th}$ longitudinal pixel row, (ii) a first control line Ei, a scanning line Gi, a third control line Ri, and a second power supply line Xpi are provided for an $i^{th}$ horizontal pixel row, and (iii) a second control line AZC provided commonly for the $i^{th}$ horizontal pixel row and a $(i-1)^{th}$ horizontal pixel row.

The gate driver GDR drives the scanning line Gi in accordance with a clock pulse CK and a start pulse SDR received from the display control circuit DCC. The source driver SDR drives the data line Sj and the first power supply line Ypj in accordance with a clock signal CK and a start pulse SP received from the display control circuit DCC. The light-emitting driver EDR drives the first control line Ei in accordance with a clock signal CK and a start pulse SP received from the display control circuit DCC. The correction driver RDR drives the second power supply line Xpi and the third control line Ri in accordance with a clock signal CK and a start pulse SP received from the display control circuit DCC. The initialization driver ID drives the second control line AZC in accordance with a clock signal CK and a start pulse SP received from the display control circuit DCC. Note that the light-emitting driver EDR is mounted or monolithically provided so as to extend along one side of a rectangular shape of the pixel array substrate PAS, the gate driver GDR and a correction driver RDR circuit are mounted or monolithically provided so as to extend along that side of the rectangular shape of the pixel array substrate PAS which is opposite to the one side, and the initialization driver IDR is mounted or monolithically provided near a corner of the rectangular shape of the pixel array substrate PAS so as to be adjacent to the gate driver GDR.

Figure 2:
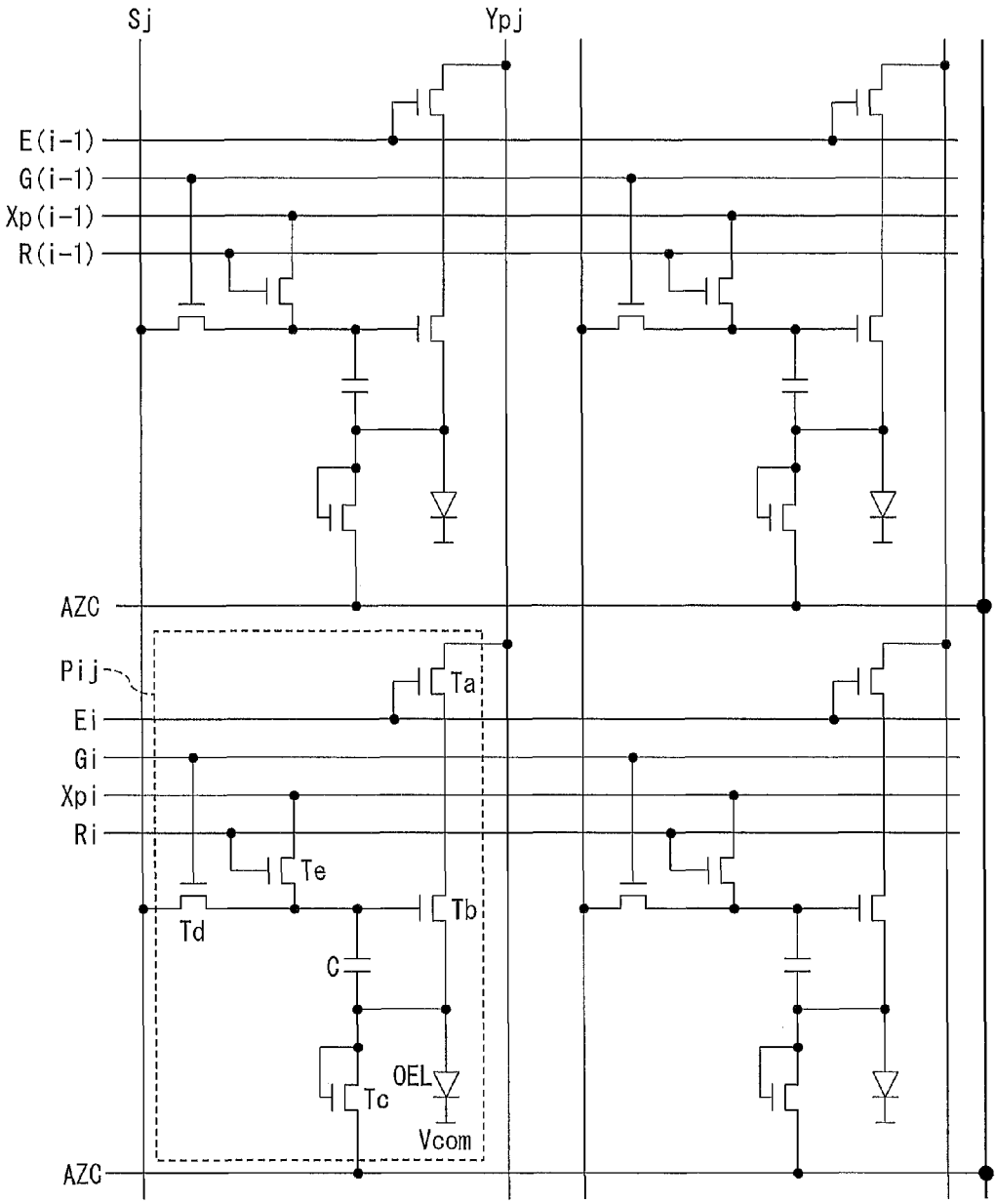
FIG. 2 is a circuit view partially showing a configuration of a pixel array (four pixels) in accordance with Embodiment 1.

FIG. 2 partially shows a configuration of a pixel array (four pixels) in accordance with Embodiment 1. As shown in FIG. 2, an organic EL element (organic light-emitting diode, light-emitting element) OEL, five n-channel transistors Ta through Te (first through fifth transistors), and a capacitor C are provided in a pixel circuit Pij provided at an intersection of the $i^{th}$ horizontal pixel row and the $j^{th}$ longitudinal pixel row.

Note, here, that (i) a gate terminal of the transistor Ta is connected to the first control line Ei, (ii) a gate terminal of the transistor Td is connected to the scanning line Gi, (iii) a gate terminal of the transistor Te is connected to the third power line Ri, (iv) a gate terminal of the transistor Tb (drive transistor) is connected to the data line Sj via the transistor Td and to the second power supply line Xpi via the transistor Te, (v) a drain terminal of the transistor Tb is connected to the first power supply line Ypj via the transistor Ta, (vi) the capacitor C is connected between a source terminal and a gate terminal of the transistor Tb, (vii) the source terminal of the transistor Tb is connected to an anode of the organic EL element OEL and to the second control line AZC, which is shared commonly by pixels of the $(i-1)^{th}$ horizontal pixel row and the $i^{th}$ horizontal pixel row which is immediately upstream to the $(i-1)^{th}$ horizontal pixel row, via the transistor Tc, (viii) a cathode of the organic EL element OEL is connected to Vcom, and (xi) a gate terminal and a drain terminal of the transistor Tc are connected to each other.

Figure 3:
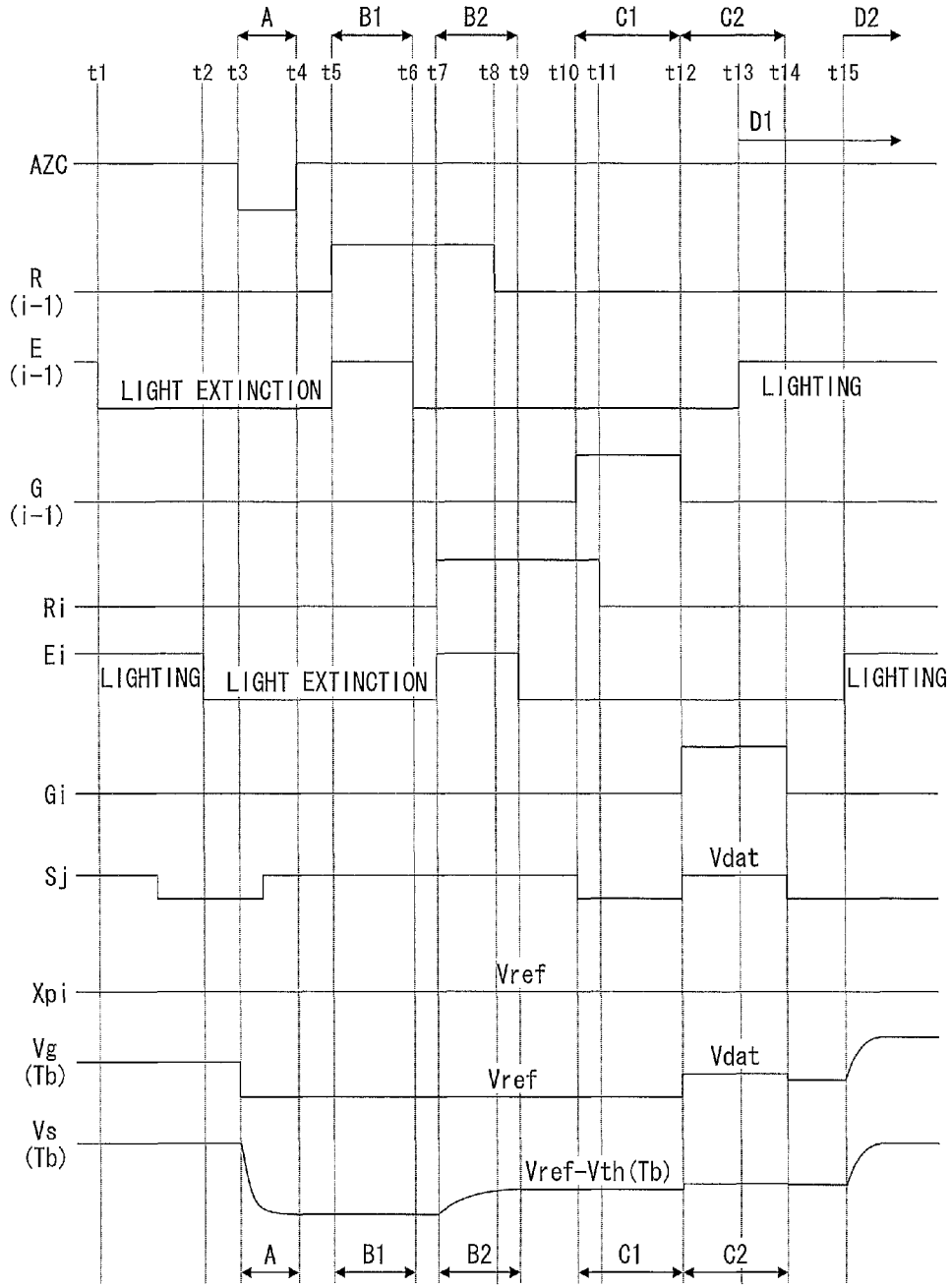
FIG. 3 is a timing chart showing a method for driving the pixel array shown in FIG. 2.

FIG. 3 shows a method for driving the pixel array substrate PAS in which pixels as shown in FIG. 2 are provided. In FIG. 3, (i) AZC indicates an electric potential of the second control line AZC shared commonly by the $(i-1)^{th}$ horizontal pixel row and $i^{th}$ horizontal pixel row immediately downstream to the $(i-1)^{th}$ horizontal pixel row, (ii) R(i−1) indicates an electric potential of a third control line R(i−1) of the $(i-1)^{th}$ horizontal pixel row, (iii) E(i−1) indicates an electric potential of a first control line E(i−1) of the $(i-1)^{th}$ horizontal pixel row, (iv) G(i−1) indicates an electric potential of a scanning line G(i−1) of the $(i-1)^{th}$ horizontal pixel row, (v) Ri indicates an electric potential of the third control line Ri of the $i^{th}$ horizontal pixel row, (vi) Ei indicates an electric potential of the first control line Ei of the $i^{th}$ horizontal pixel row, (vii) Gi indicates an electric potential of the scanning line Gj of the $i^{th}$ horizontal pixel row, (viii) Sj indicates an electric potential of the data line Sj, (ix) Xpi indicates an electric potential of the second power supply line Xpi, (x) Vg(Tb) indicates a gate electric potential of the transistor Tb in the $i^{th}$ horizontal pixel row, and (xi) Vs(Tb) indicates a source electric potential of the transistor Tb in the $i^{th}$ horizontal pixel row.

As shown in FIG. 3, the first control line E(i−1) of the $(i-1)^{th}$ horizontal pixel row is changed from "High" to "Low" at t1, and the first control line Ei of the $i^{th}$ horizontal pixel row is changed from "High" to "Low" at t2. This turns OFF the transistor Ta in the $(i-1)^{th}$ horizontal pixel row and the transistor Ta in the $i^{th}$ horizontal pixel row in this order (that is, the organic EL element OEL in the $(i-1)^{th}$ horizontal pixel row and the organic EL element OEL in the $i^{th}$ horizontal pixel row are turned off in this order).

Then, the second control line AZC shared commonly by the $(i-1)^{th}$ and $i^{th}$ horizontal pixel rows is changed from "High" to "Low" at t3 at which both of the first control lines E(i−1) and Ei in the respective $(i-1)^{th}$ and $i^{th}$ horizontal pixel rows are being "Low". This starts a period A during which the anode electric potentials of the organic EL elements OEL in the respective $(i-1)^{th}$ and $i^{th}$ horizontal pixel rows are being subjected to initialization. In the $i^{th}$ horizontal pixel row, the transistor Tc are being turned ON during the period A so that a source electric potential of the drive transistor Tb (which is the anode electric potential of the organic EL element OEL) Vs(Tb) becomes VL(AZ)+Vth(Tc) by the initialization, where VL(AZ) is a "Low" electric potential of the second control line AZC and Vth(Tc) is a threshold electric potential of the transistor Tc. Note, here, that VL(AZ)+Vth(Tc) is set to less than a light-emitting threshold value Vth(EL) of the organic EL element OEL so that a current is being prevented from flowing through the organic EL element OEL during the period A. Note that it is desirable that an aspect ratio (W/L ratio) of the transistor Tc is smaller than an aspect ratio (W/L ratio) of the transistor Tb in view of the following. While the anode electric potential of the organic EL element OEL is being subjected to the initialization, a current is flowing through a path passing through the first power supply line Ypj, the transistor Ta, the transistor Tb, the transistor Tc, and the first control line AZC in this order. However, with the aspect ratio of Tc being set to less than that of Tb, only a smaller current flows through Tb (that is, electric stress on Tb is decreased). This can prevent characteristic fluctuation of the transistor Tb, whose characteristic variance affects display quality the most, from being significantly large.

Then, the second control line AZC shared commonly by the $(i-1)^{th}$ and $i^{th}$ horizontal pixel rows is changed from "Low" to "High". This ends the period A. Note that, in the $(i-1)^{th}$ horizontal pixel row, similarly to the $i^{th}$ horizontal pixel row, the anode electric potential of the organic EL element OEL is subjected to initialization.

Both of the first control line E(i−1) of the $(i-1)^{th}$ horizontal pixel row and the third control line (i−1) of the $(i-1)^{th}$ horizontal pixel row are changed from "Low" to "High" at t5. This starts a period B1 within which the threshold value of the drive transistor in the $(i-1)^{th}$ horizontal pixel row is detected. Then, the first control line E(i−1) of the $(i-1)^{th}$ horizontal pixel row is changed from "High" to "Low" at t6. This ends the period B1.

After this, the first control line Ei of the $i^{th}$ pixel row and the third control line Ri of the $i^{th}$ horizontal pixel row are changed from "Low" to "High" at t7. This starts the period B2 within the threshold value of the drive transistor (Tb) in the $i^{th}$ horizontal pixel row is detected. As such, the transistor Te is being turned ON during the period B2. This causes the gate electric potential Vg(Tb) of the transistor Tb to become an electric potential Vref of the second power supply line Xpi.

Note, here, that Vref is set to such a value that the following expressions (1) and (2) are satisfied.

$$V\text{ref} > VL(AZ) + V\text{th}(Tc) + V\text{th}(Tb) \quad (1):$$

and $$V\text{ref} < V\text{th}(EL) + V\text{th}(Tb) \quad (2);$$

where Vth(Tb) is a threshold electric potential of the transistor Tb and Vth(Tc) is a threshold electric potential of the transistor Tc. As such, although the transistor Tb is turned ON within the period B2, a current is prevented from flowing through the organic EL element OEL. This causes the source electric potential of the transistor Tb (=the anode electric potential of the organic EL element OEL) to be increased from Vss by a current supplied from the first power supply line Yp. Then, the transistor Tb is turned OFF after the source electric potential Vs(Tb) of the transistor Tb is increased so that Vs(Tb)=Vref−Vth(Tb).

Then, the third control line R(i−1) of the $(i-1)^{th}$ horizontal row is changed from "High" to "Low" at t8, and the first control line Ei of the $i^{th}$ horizontal row is changed from "High" to "Low" at t9. This ends the period B2 to be finished.

The scanning line G(i−1) of the $(i-1)^{th}$ horizontal pixel row is changed from "Low" to "High" at t10. This starts a period C1 which is a data writing period of the $(i-1)^{th}$ horizontal pixel row. Then, the third control line Ri of the $i^{th}$ horizontal pixel row is changed from "High" to "Low" at t11. Then, the scanning line G(i−1) of the $(i-1)^{th}$ horizontal pixel row is changed from "High" to "Low" at t12. This ends the period C1.

The scanning line Gi of the $i^{th}$ horizontal pixel row is changed from "Low" to "High" at t12. This starts a period C2 which is a data wiring period of the $i^{th}$ horizontal pixel row. As such, a data signal electric potential Vdat is being written into the gate terminal of the transistor Tb via the data line Sj during the period C2. This causes the gate electric potential Vg(Tb) of the transistor Tb to be Vg(Tb)=Vdat. At this time, a voltage Vgs applied between the gate terminal and the source terminal of the transistor Tb is:

$$Vgs=(Cel/(Cel+Cst))\times(V\text{dat}-V\text{ref})+V\text{th}(Tb),$$

where Cst is a capacitor formed between the gate terminal and the source terminal of the transistor Tb and Cel is a capacitance of the organic EL element OEL. However, because a value of Cel is significantly larger than that of Cst, the above equation can be practically rewritten to an equation (3) below:

$$Vgs=V\text{dat}-V\text{ref}+V\text{th}(Tb) \quad (3).$$

As such, a value of the voltage Vgs applied between the gate terminal and the source terminal of the transistor Tb corresponds to the data.

The first control line E(i−1) of the $(i-1)^{th}$ horizontal pixel row is changed from "Low" to "High" at 13. This starts a period D1 during which the organic EL element OEL in the $(i-1)^{th}$ horizontal pixel row is emitting light. Note that a period between t1 and t13 is a light extinction period (a black insertion period) of the $(i-1)^{th}$ horizontal pixel row.

Then, the scanning line Gi of the $i^{th}$ horizontal pixel row is changed from "High" to "Low" at t14. This ends the period C2. Then, the first control line Ei of the $i^{th}$ horizontal pixel row is changed from "Low" to "High" at t15. This starts a period D2 during which the organic EL element OEL in the $i^{th}$ horizontal pixel row is emitting light. Note that a period between t2 and t15 is a light extinction period (a black insertion periods) of the $i^{th}$ horizontal pixel row. As such, a current corresponding to Vgs (the voltage applied between the gate terminal and the source terminal of the transistor Tb) flows through the organic EL element OEL from the first power supply line Ypj via the transistors Ta and Tb. At this time, the gate terminal of the transistor Tb is electrically floated. As such, the gate electric potential of the transistor Tb is increased as the source electric potential of the transistor Tb is increased. This keeps Vgs to a substantially fixed level. Note, here, that, in a case where the electric potential of the first power supply line Yp is set to such a value that the transistor Tb operates in a saturation region, a channel length modulation effect can be ignored. As such, a drain current flowing from the transistor Tb is:

$$Ib=(W\times\mu\times Cox\times(Vgs-V\text{th}(Tb))^2)/(2\times L),$$

where L is a cannel length, W is a channel width, μ is an electron mobility, Cox is a capacitance of an oxide. This equation can be rewritten as follows by replacing Vgs with the equation (3):

$$Ib=(W\times\mu\times Cox\times(V\text{dat}-V\text{ref})^2/(2\times L).$$

That is, the drain current Ib (which is a current flowing through the organic El element OEL) can be set to a value corresponding to Vdat, irrespectively of a variance of threshold values Vth(Tb) from one pixel circuit to another and changes in the threshold values Vth(Tb) that occur over a course of time.

As described above, in the display device of the present embodiment in which the second control line AZC is provided commonly for the $(i-1)^{th}$ and $i^{th}$ horizontal pixel rows, (i) the anode electric potentials in two or more horizontal pixel rows can be concurrently subjected to the initialization and (ii) the lighting periods in the respective two or more pixels horizontal pixel rows (pixels) can be set to same timings (that is, the lighting periods in the respective two or more pixels horizontal pixel rows (pixels) can be made identical with each other). This makes it possible that an effect that the number of second control lines necessary to be independently driven (and the number of outputs for the respective second control lines) is decreased to fewer than that in a conventional arrangement (see FIG. 16), and the initialization driver IDR is simplified in configuration and reduced in size. This can make mounting of the initialization driver IDR easier and requires less drawing around of wiring lines. This can achieve improved productivity. Because the initialization driver IDR is simplified in configuration and reduced in size as described above, it can be mounted or monolithically provided near one corner of the rectangular shape of the pixel array substrate PAS (see FIG. 1).

Note that, in a case where light extinction periods (black insertion periods) of respective pixels are extended so that increased number of horizontal pixel rows can commonly share one second control line as their second control lines, there can be a further decrease in the number of outputs of the initialization driver IDR (and the number of the second control lines necessary to be independently driven). For example, in a case where the light extinction periods of the respective pixels are set to half-frame periods so that a half of entire horizontal pixel rows commonly share a same second control line, required number of outputs of the initialization driver IDR is decreased to two. As such, in a case where the display device of Embodiment 1 is a full-HD display device, 1078 outputs, out of 1080 outputs, of the initialization driver IDR can be omitted. Note, also, that the anode electric potentials in the entire horizontal pixel rows (pixels) can be concurrently subjected to the initialization, after lights in the entire horizontal pixel rows are extinguished sequentially from one horizontal pixel row to another after scanning of the entire horizontal pixel rows sequentially one after another. In this case, the required number of outputs of the initialization driver IDR can be decreased to one. Note that the number of outputs of the initialization driver IDR should be determined in consideration of factors such as required lighting periods, characteristics of the organic EL elements OEL and the transistors, and an allowable driver circuit area.

Figure 16:
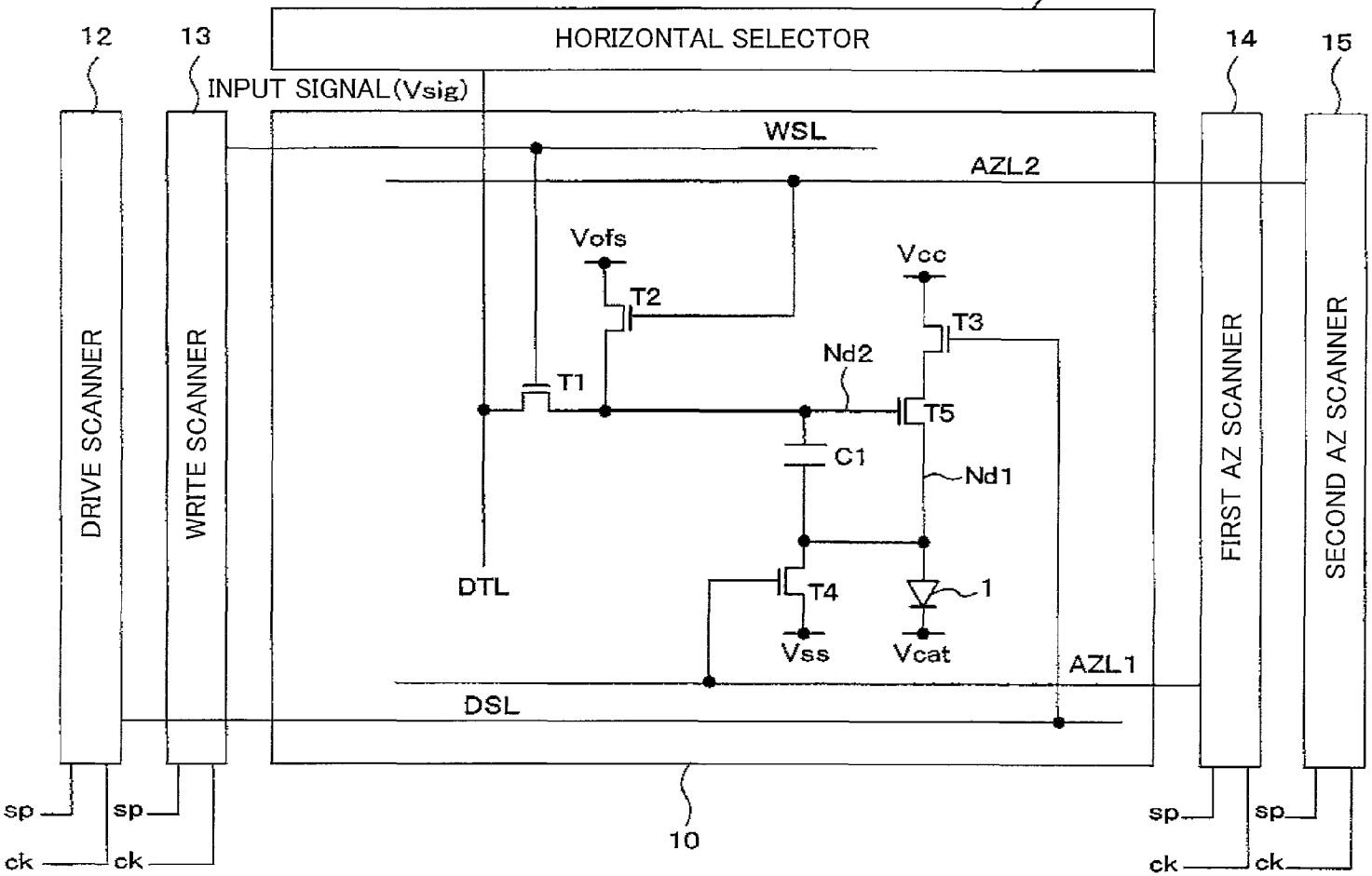
FIG. 16 is a pixel circuit view showing a conventional display device.

Note, also, that, in the display device of Embodiment 1 in which the transistor Tc is diode-connected, required number of power supply lines can be decreased to fewer than that in a conventional arrangement (see FIG. 16). This can increase an aperture ratio and reduce parasitic capacitance formed between each power supply line and a corresponding line (for example, a data line) intersecting with that power supply line. Further, it is also possible that power supply lines and respective corresponding lines intersecting with them are short-circuited less, so that a higher yield ratio (that is, a higher productivity) can be achieved. Furthermore, in this case, because it is only necessary that a gate terminal and a drain terminal of a same element are short-circuited (that is, connected to each other), drawing around of lines in a pixel circuit can be simplified and a required layout area can be decreased. This also makes it possible that required number of power supply circuits within a driver is decreased to fewer than that in the conventional arrangement (see FIG. 16).

Further, the display device of Embodiment 1 brings about an advantageous driving effect described as follows. A current is passing through a path passing through the first power supply line Ypj, the transistors Ta, Tb, and Tc, and the second control line AZC during the period A (that is, a reset period during which the anode electric potential of the organic EL element OEL is being reset). According to Embodiment 1, the voltage Vgs applied between the gate terminal and the source terminal of the transistor Tc is equivalent to a voltage Vds applied between the drain terminal and the source terminal of the transistor Tc, so that the transistor Tc always operates in the saturation region. In the saturation region, a drain current Ic flowing from the transistor Tc is:

$$Ic=((W\times\mu\times Cox\times(vgs-Vth(Tc))^2)/(2\times L).$$

As such, unlike the conventional arrangement (see FIG. 16), no high current flows through the transistor Tc. That is, according to the display device of Embodiment 1, a current limiter function is realized which works during the initialization of the anode electric potential.

Embodiment 2

Figure 4:
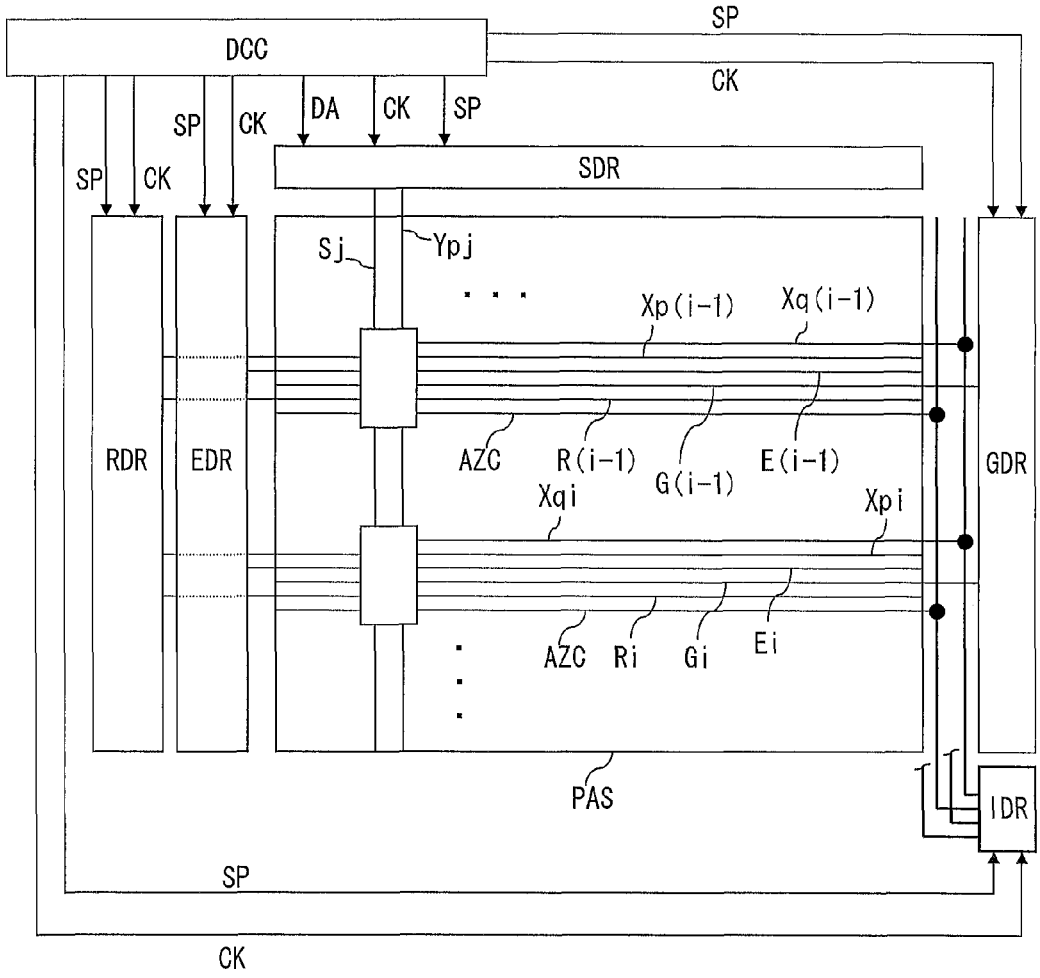
FIG. 4 is a view schematically showing how a present display device is configured in accordance with Embodiment 2.

FIG. 4 is a block view showing how a display device is configured in accordance with Embodiment 2. As shown in FIG. 4, the display device includes a pixel array substrate PAS, a display control circuit DCC, a light-emitting driver EDR, a gate driver GDR, a correction driver RDR, an initialization driver IDR, and a source driver SDR. The pixel array substrate PAS includes wiring lines in which, for example, (i) a first power supply line Ypj and a data line Sj are provided for a $j^{th}$ longitudinal pixel row, (ii) a first control line Ei, a scanning line Gi, a third control line Ri, a second power supply line Xpi, and an initialization electric potential supply line Xqi are provided for an $i^{th}$ horizontal pixel row, and (iii) a second control line AZC is provided commonly for $(i-1)^{th}$ and $i^{th}$ horizontal pixel rows.

The gate driver GDR drives the scanning line Gi in accordance with a clock pulse CK and a start pulse SP received from the display control circuit DCC. The source driver SDR drives the data line Sj and the first power supply line Ypj in accordance with a clock signal CK and a start pulse SP received from the display control circuit DCC. The light-emitting driver EDR drives the first control line Ei in accordance with a clock signal CK and a start pulse SP received from the display control circuit DCC. The correction driver RDR drives the second power supply line Xpi and the third control line Ri in accordance with a clock signal CK and a start pulse SP received from the display control circuit DCC. The initialization driver IDR drives the second control line AZC and the initialization electric potential supply line Xqi in accordance with a clock signal CK and a start pulse SP received from the display control circuit DCC. Note that the light-emitting driver EDR is mounted or monolithically provided so as to extend along one side of a rectangular shape of the pixel array substrate PAS, the gate driver GDR and a correction driver RDR circuit are mounted or monolithically provided so as to extend along that side of the rectangular shape of the pixel array substrate PAS which is opposite to the one side, and the initialization driver IDR is mounted or monolithically provided near a corner of the rectangular shape of the pixel array substrate PAS so as to be adjacent to the gate driver GDR.

Figure 5:
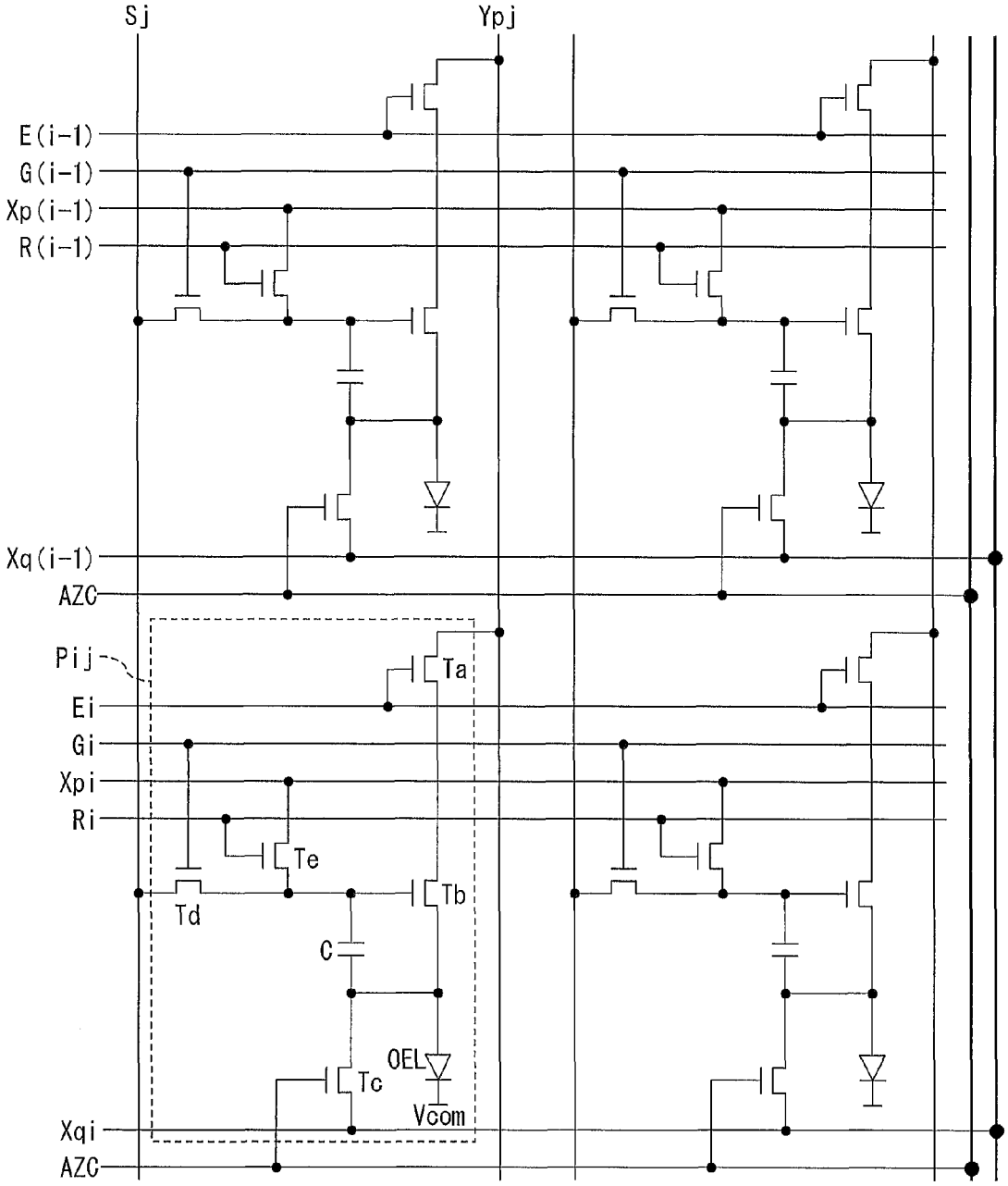
FIG. 5 is a circuit view partially showing a configuration of a pixel array (four pixels) in accordance with Embodiment 2.

FIG. 5 partially shows a configuration of the pixel array substrate PAS (four pixels) in accordance with Embodiment 2. As shown in FIG. 5, an organic EL element (organic light-emitting diode, light-emitting element) OEL, five n-channel transistors Ta through Te (first through fifth transistors), and a capacitor C are provided in a pixel circuit Pij provided at an intersection of the $i^{th}$ horizontal pixel row and the $j^{th}$ longitudinal pixel row.

Note, here, that (i) a gate terminal of the transistor Ta is connected to the first control line Ei, (ii) a gate terminal of the transistor Td is connected to the scanning line Gi, (iii) a gate terminal of the transistor Te is connected to the third control line Ri, (iv) a gate terminal of the transistor Tb (driver transistor) is connected to the data line Sj via the transistor Td and to the second power supply line Xpi via the transistor Te, (v) a drain terminal of the transistor Tb is connected to the first power supply line Ypj via the transistor Ta, (vi) the capacitance C is connected between the gate terminal and a source terminal of the transistor Tb, (vii) the source terminal of Tb is connected to an anode of the organic EL element OEL and to the initialization electric potential supply line Xqi via the transistor Tc, (viii) a cathode of the organic EL element OEL is connected to Vcom, and (ix) a gate terminal of the transistor Tc is connected to the second control line AZC shared commonly by the $(i-1)^{th}$ horizontal pixel row and the $i^{th}$ horizontal pixel row which is immediately downstream to the $(i-1)^{th}$ horizontal pixel row.

Figure 6:
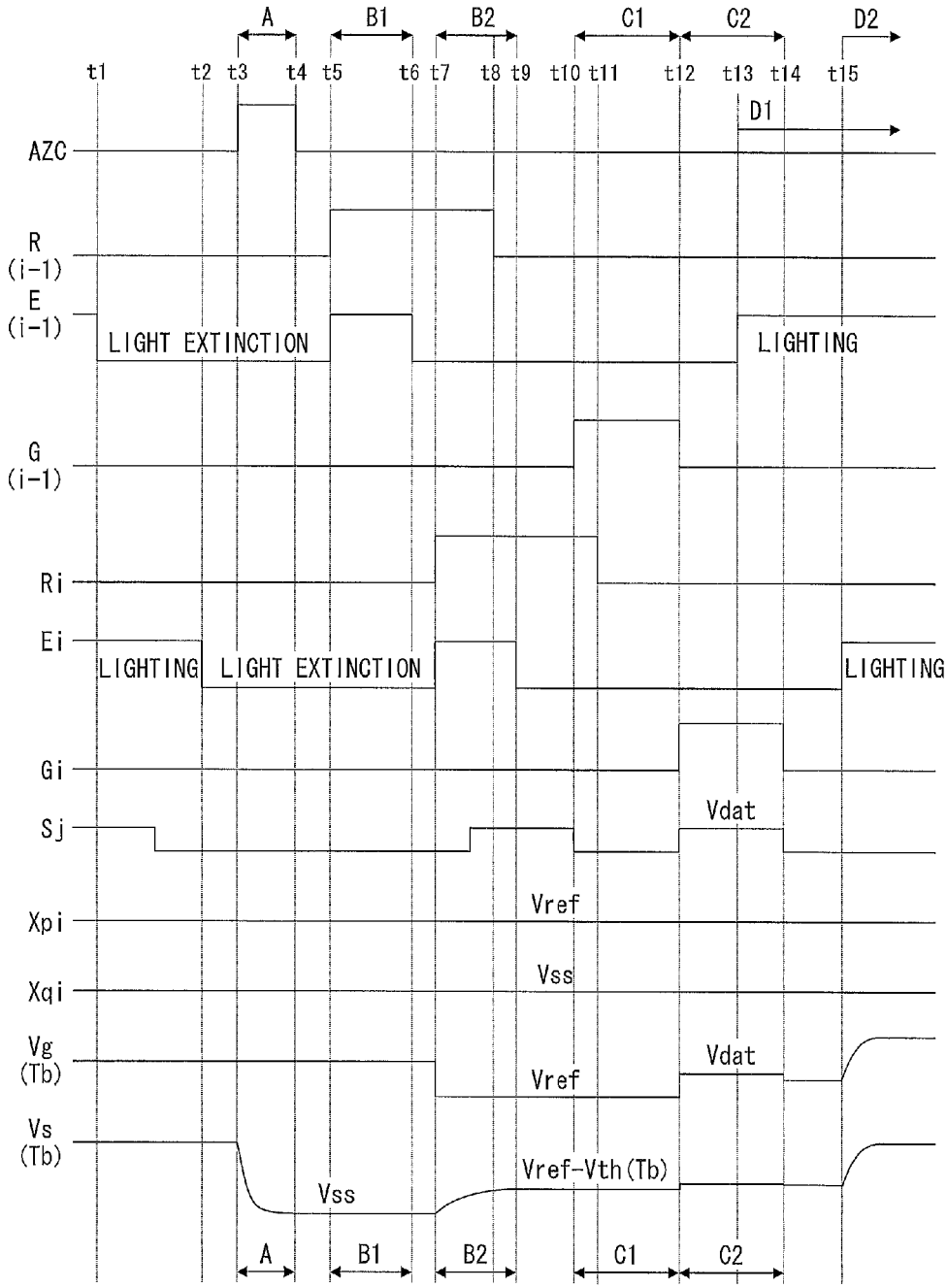
FIG. 6 is a timing chart showing a method for driving the pixel array shown in FIG. 5.

FIG. 6 shows a method for driving the pixel array substrate PAS in which pixel circuits as shown in FIG. 5 are provided. In FIG. 6, (i) AZC indicates an electric potential of the second control line AZC commonly shared by the $(i-1)^{th}$ and $i^{th}$ horizontal pixel rows, (ii) R(i−1) indicates an electric potential of a third control line R(i−1) of the $(i-1)^{th}$ horizontal pixel row, (iii) E(i−1) indicates an electric potential of a first control line E(i−1) of the $(i-1)^{th}$ horizontal pixel row, (iv) Gi indicates an electric potential of a scanning line G(i−1) in the $(i-1)^{th}$ horizontal pixel row, (v) Ri indicates an electric potential of the third control line Ri of the $i^{th}$ horizontal pixel row, (vi) Ei indicates an electric potential of the first control line Ei of the $i^{th}$ horizontal pixel row, (vii) Gi indicates an electric potential of the scanning line Gj of the $i^{th}$ horizontal pixel row, (viii) Sj indicates an electric potential of the data line Sj, (ix) Xpi indicates an electric potential of the second power supply line Xpi, (x) Xqi indicates an electric potential of the initialization electric potential supply line Xqi, (xi) Vg(Tb) indicates a gate electric potential of the transistor Tb in the $i^{th}$ horizontal pixel row, and (xii) Vs(Tb) indicates a source electric potential of the transistor Tb in the $i^{th}$ horizontal pixel row.

As shown in FIG. 6, the first control line E(i−1) of the $(i-1)^{th}$ horizontal pixel row is changed from "High" to "Low" at t1, and the first control line Ei is changed from "High" to "Low" at t2. This turns OFF the transistor Ta in the $(i-1)^{th}$ horizontal pixel row and the transistors Ta in the $i^{th}$ horizontal pixel row in this order (that is, an organic EL element OEL in the $(i-1)^{th}$ horizontal pixel row and the organic EL element OEL in the $i^{th}$ horizontal pixel row are turned off in this order).

Then, the second control line AZC commonly shared by the $(i-1)^{th}$ and $i^{th}$ horizontal pixel rows is changed from "Low" to "High" at t3 at which both of the first control lines E(i−1) and Ei of the respective $(i-1)^{th}$ and $i^{th}$ horizontal pixel rows are being "Low", so that a period A is started during which anode electric potentials of the organic EL elements in the respective $(i-1)^{th}$ and $i^{th}$ horizontal pixel rows are being subjected to initialization. In the $i^{th}$ horizontal pixel row, the transistor Tc is being turned ON during the period A, so that a source electric potential Vs(Tb) of the drive transistor Tb (the anode electric potential of the organic EL element OEL) becomes an electric potential Vss of the initialization electric potential supply line Xqi by the initialization. The electric potential Vss is set to less than a light-emitting threshold value Vth(EL) of the organic EL element OEL so that a current is prevented from flowing through the organic EL element OEL during the period A. Note that it is desirable that an aspect ratio (W/L ratio) of the transistor Tc is smaller than an aspect ratio (W/L ratio) of the transistor Tb in view of the following. While the anode electric potential of the organic EL element OEL is being subjected to the initialization, a current is flowing through a path passing through the first power supply line Ypj, the transistor Ta, the transistor Tb, the transistor Tc, and the first control line AZC in this order. However, with the aspect ratio of Tc being set to smaller than that of Tb, only a smaller current flows through the transistor Tb (that is, electric stress on the transistor Tb is decreased). This can prevent characteristic fluctuation of the transistor Tb, whose characteristic variance affects display quality the most, from being significantly large.

The second control line AZC commonly shared by the $(i-1)^{th}$ and $i^{th}$ horizontal pixel row is changed from "High" to "Low" at t4. This ends the period A. In the $(i-1)^{th}$ horizontal pixel row, similarly to the $i^{th}$ horizontal pixel row, an anode electric potential of an organic EL element OEL is subjected to initialization.

Both of the first control line E(i−1) and the third control line R(i−1) of the $(i-1)^{th}$ horizontal pixel row are changed from "Low" to "High" during t5. This starts a period B1 within which a threshold value of the drive transistor in the $(i-1)^{th}$ horizontal pixel row is detected. Then, the first control line E(i−1) of the $(i-1)^{th}$ horizontal pixel row is changed from "High" to "Low" at t6. This ends the period B1.

Subsequently, both of the first control line Ei and the third control line Ri in the $(i-1)^{th}$ horizontal pixel row are changed from "Low" to "High" at t7. This starts a period B2 within which a threshold value of the drive transistor (Tb) in the $(i-1)^{th}$ horizontal pixel row is detected. The transistor Te is being turned ON during the period B2 so that the gate electric potential Vg(Tb) of the transistor Tb becomes an electric potential Vref of the second power supply line Xpi.

Note, here, that the electric potential Vref is set to such a value that the following mathematical expressions (4) and (5) are satisfied.

$$Vref > Vss + Vth(Tb) \quad (4);$$

and $$Vref < Vth(EL) + Vth(Tb) \quad (5),$$

where Vth(Tb) is a threshold electric potential of the transistor Tb and Vth(Tc) is a threshold electric potential of the transistor Tc.

As such, although the transistor Tb is turned ON within the period B2, no current flows through the organic EL element OEL. This increases the source electric potential Vs(Tb) of the transistor Tb (which is equivalent to the anode electric potential of the organic EL element OEL) from Vss by the current supplied from first power supply line Ypj. Then, the transistor Tb is turned OFF after the source electric potential Vs(Tb) of the transistor Tb is increased so that Vs(Tb)=Vref−Vth(Tb).

The third control line R(i−1) in the $(i-1)^{th}$ horizontal pixel row is changed from "High" to "Low" at t8, and the first control line Ei in the $i^{th}$ horizontal pixel row is changed from "High" to "Low" at t9. This ends the period B2.

Then, the scanning line G(i−1) in the $(i-1)^{th}$ horizontal line is changed from "Low" to "High" at t10. This starts a period C 1 which is a data writing period of the $(i-1)^{th}$ horizontal pixel row. Then, the third control line Ri in the $i^{th}$ horizontal pixel row is changed from "High" to "Low" at t11. Then, the scanning line G(i−1) in the $(i-1)^{th}$ horizontal pixel row is changed from "High" to "Low" at t12. This ends the period C1.

The scanning line Gi of the $i^{th}$ horizontal pixel row is changed from "Low" to "High" at t12. This starts a period C2 which is a data writing period of the $i^{th}$ horizontal pixel row. As such, a data signal electric potential Vdat is being written into the gate terminal of the transistor Tb from the data line Sj during the period C2. This causes a gate electric potential Vg(Tb) of the transistor Tb to become Vdat. At this time, a voltage Vgs applied between the gate terminal and the source terminal of the transistor Tb is:

$$Vgs = ((Cel/(Cel+Cst)) \times (Vdat - Vref) + Vth(Tb),$$

where Cst is a capacitor formed between the gate terminal and the source terminal of the transistor Tb and Cel is a capacitance of the organic EL element OEL. However, because a value of Cel is significantly larger than that of Cst, the above equation can be practically rewritten to an equation (6) below:

$$Vgs = Vdat - Vref + Vth(Tb) \quad (6).$$

As such, the voltage Vgs applied between the gate terminal and the source terminal of the transistor Tb has a value corresponding to data.

The first control line E(i−1) is changed from "Low" to "High" at t13. This starts a period D1 during which the organic EL element OEL in the $(i-1)^{th}$ horizontal pixel row is emitting light. Note that a period between t1 and t13 is a light extinction period (that is, a black insertion period) of the $(i-1)^{th}$ horizontal pixel row.

Then, the scanning line Gi of the $i^{th}$ horizontal pixel row is changed from "High" to "Low" at t14. This ends the period C2. After this, the first control line Ei of the $i^{th}$ horizontal pixel row is changed from "Low" to "High" at t15. This starts a period D2 during which the organic EL element OEL in the $i^{th}$ horizontal pixel row is emitting light. Note that a period between t2 and t15 is a light extinction period (that is, black insertion periods) of the $i^{th}$ horizontal pixel row. As such, a current corresponding to Vgs (the voltage applied between the gate terminal and the source terminal of the transistor Tb) flows from the first power supply line Ypj to the organic EL element OEL in the $i^{th}$ horizontal pixel row via the transistors Ta and Tb. At this time, the gate terminal of the transistor Tb is electrically floated. As such, the gate electric potential of the transistor Tb is increased as the source electric potential of the transistor Tb is increased. This keeps Vgs to a substantially fixed level. Note, here, that, in a case where the electric potential of the first power supply line Yp is set to such a value that the transistor Tb operates in a saturation region, a channel length modulation effect can be ignored. In this case, a drain current Ib flowing from the transistor Tb is:

$$Ib = (W \times \mu \times Cox \times (Vgs - Vth(Tb))^2)/(2 \times L),$$

where L is a cannel length, W is a channel width, μ is an electron mobility, Cox is a capacitance of an oxide. This equation can be rewritten as follows by replacing Vgs with the equation (6), $$Ib = (W \times \mu \times Cox \times (Vdat - Vref)^2/(2 \times L).$$

That is, the drain Ib (that is, a current flowing through the organic El element OEL) can be set to a value corresponding to Vdat, irrespectively of variances of threshold values Vth (Tb) from one pixel circuit to another and changes in the threshold values Vth(Tb) that occur over a course of time.

As described above, the second control AZC line can be shared commonly by the $(i-1)^{th}$ and $i^{th}$ horizontal pixel rows in the display device of Embodiment 2. This makes it possible that required number of second control lines necessary to be independently driven (and required number of outputs for the respective second control lines) is decreased to fewer than that in the conventional arrangement (see FIG. 16), and the initialization driver IDR is simplified in configuration and reduced in size. This can make mounting of the initialization driver IDR easier and requires less drawing around of wiring lines, so that higher productivity can be achieved. This makes it possible that the initialization driver IDR is mounted or monolithically provided near a corner of the rectangular shape of the pixel array substrate PAS, as shown in FIG. 4.

Note that, in a case where light extinction periods (black insertion periods) of pixels are extended so that increased number of horizontal pixel rows (pixels) can share a same line commonly as their second control lines, it is possible that required number of outputs of the initialization driver IDR (and the number of the second control lines necessary to be independently driven) is further decreased. For example, in a case where the light extinction periods of the pixels are set to half-frame periods so that a half of entire horizontal pixel rows shares a same second control line, required number of outputs of the initialization driver IDR is decreased to two. As such, in a case where the display device of Embodiment 2 is a full-HD display device, 1078 outputs, out of 1080 outputs, of the initialization driver IDR can be omitted. Note, also, that, the anode electric potentials in the entire horizontal pixel rows (pixels) can be concurrently subjected to initialization, after lights in the pixels are extinguished sequentially from one horizontal pixel row to another after scanning of the entire horizontal pixel rows one after another sequentially. This makes it possible that the required number of outputs of the initialization driver IDR is decreased to one. Note that the number of outputs of the initialization driver IDR should be determined in consideration of factors such as required lighting periods, characteristics of the organic EL element OEL and the transistors, and an allowable driver circuit area.

Embodiment 3

Figure 7:
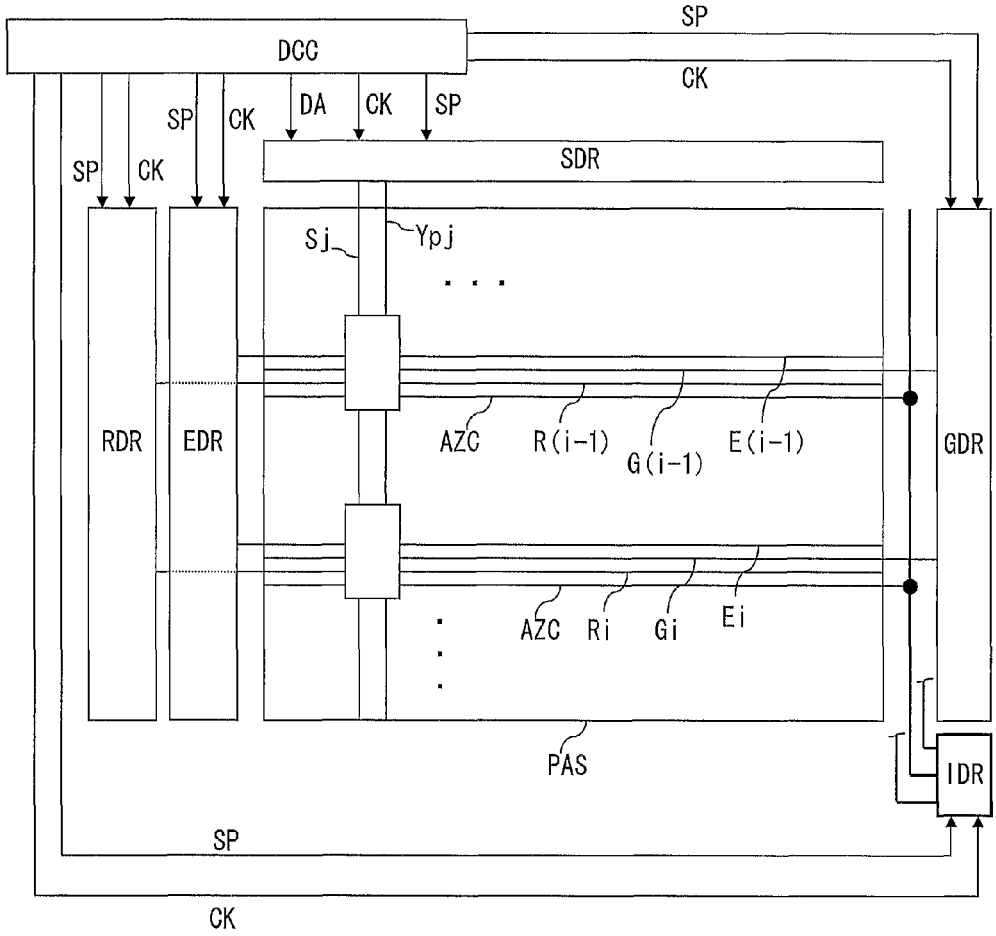
FIG. 7 is a view schematically showing how a present display device is configured in accordance with Embodiment 3.

FIG. 7 is a block view showing how a display device is configured in accordance with Embodiment 3. As shown in FIG. 7, the display device includes a pixel array substrate PAS, a display control circuit DCC, a light-emitting driver EDR, a gate driver GDR, a correction driver RDR, an initialization driver IDR, and a source driver SDR. The pixel array substrate PAS includes wiring lines in which, for example, (i) a first power supply line Ypj and a data line Sj are provided for a $j^{th}$ longitudinal pixel row, (ii) a first control line Ei, a scanning line Gi, a third control line Ri, a second power supply line Xpi, and an initialization electric potential supply line Xqi are provided for an $i^{th}$ horizontal pixel row, and (iii) a second control line AZC is commonly shared by $(i-1)^{th}$ and $i^{th}$ horizontal pixel rows.

The gate driver GDR drives the scanning signal line Gi in accordance with a clock pulse CK and a start pulse SDR received from the display control circuit DCC. The source driver SDR drives the data line Sj and the first power supply line Ypj in accordance with a clock signal CK and a start pulse SP received from the display control circuit DCC. The light-emitting driver EDR drives the first control line Ei in accordance with a clock signal CK and a start pulse SP received from the display control circuit DCC. The correction driver RDR drives the third control line Ri in accordance with a clock signal CK and a start pulse SP received from the display control circuit DCC. The initialization driver IDR drives the second control line AZC in accordance with a clock signal CK and a start pulse SP received from the display control circuit DCC. Note that the light-emitting driver EDR is mounted or monolithically provided so as to extend along one side of a rectangular shape of the pixel array substrate PAS, the gate driver DGR and a correction driver RDR circuit are mounted or monolithically provided so as to extend along that side of the rectangular shape of the pixel array substrate PAS which is opposite to the one side, and the initialization driver IDR is mounted or monolithically provided near a corner of the rectangular shape of the pixel array substrate PAS so as to be adjacent to the gate driver GDR.

Figure 8:
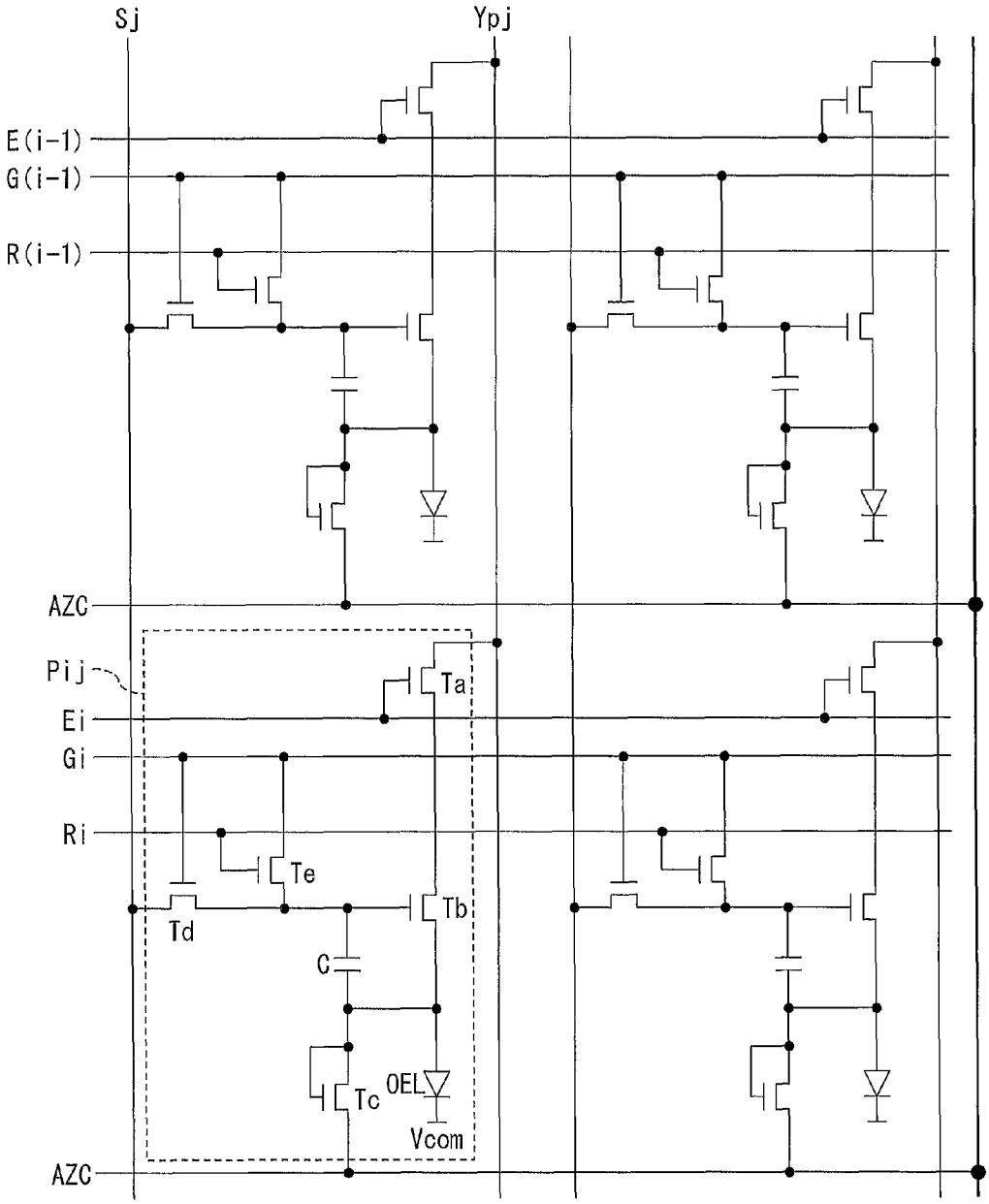
FIG. 8 is a circuit view partially showing a configuration of a pixel array (four pixels) in accordance with Embodiment 3.

FIG. 8 partially shows a configuration of the pixel array substrate PAS (four pixels) in accordance with Embodiment 3. As shown in FIG. 8, an organic EL element OEL, five n-channel transistors (field-effect transistor) Ta through Te, and a capacitor C are provided in a pixel circuit Pij provided at an intersection of the $i^{th}$ horizontal pixel row and the $j^{th}$ longitudinal pixel row.

Note, here, that (i) a gate terminal of the transistor Ta is connected to a first control line Ei, (ii) a gate terminal of the transistor Td is connected to a scanning line Gi, (iii) a gate terminal of the transistor Te is connected to a third control line Ri, (iv) a gate terminal of the transistor Tb (driver transistor) is connected to a data line Sj via the transistor Td and to a scanning line Xpi in the $i^{th}$ horizontal pixel row via the transistor Te, (v) a drain terminal of the transistor Tb is connected to a first power supply line Ypj via the transistor Ta, (vi) the capacitor C is provided between the gate terminal and a source terminal of the transistor Tb, (vii) the source terminal of the transistor Tb is connected to an anode of the organic EL element OEL and to the second control line AZC, which is commonly shared by pixels of the $(i-1)^{th}$ horizontal pixel row and the $i^{th}$ horizontal pixel row which is downstream to the $(i-1)^{th}$ horizontal pixel row are connected, via the transistor Tc (viii) a cathode of the organic EL element OEL is connected to Vcom, and (ix) the gate terminal and the drain terminal of the transistor Tc are connected to each other. That is, in the pixel circuit, the gate terminal and the drain terminal of the transistor Tc are connected to the anode of the organic EL element OEL, and the source terminal of the transistor Tc is connected to the second control line AZC.

Figure 9:
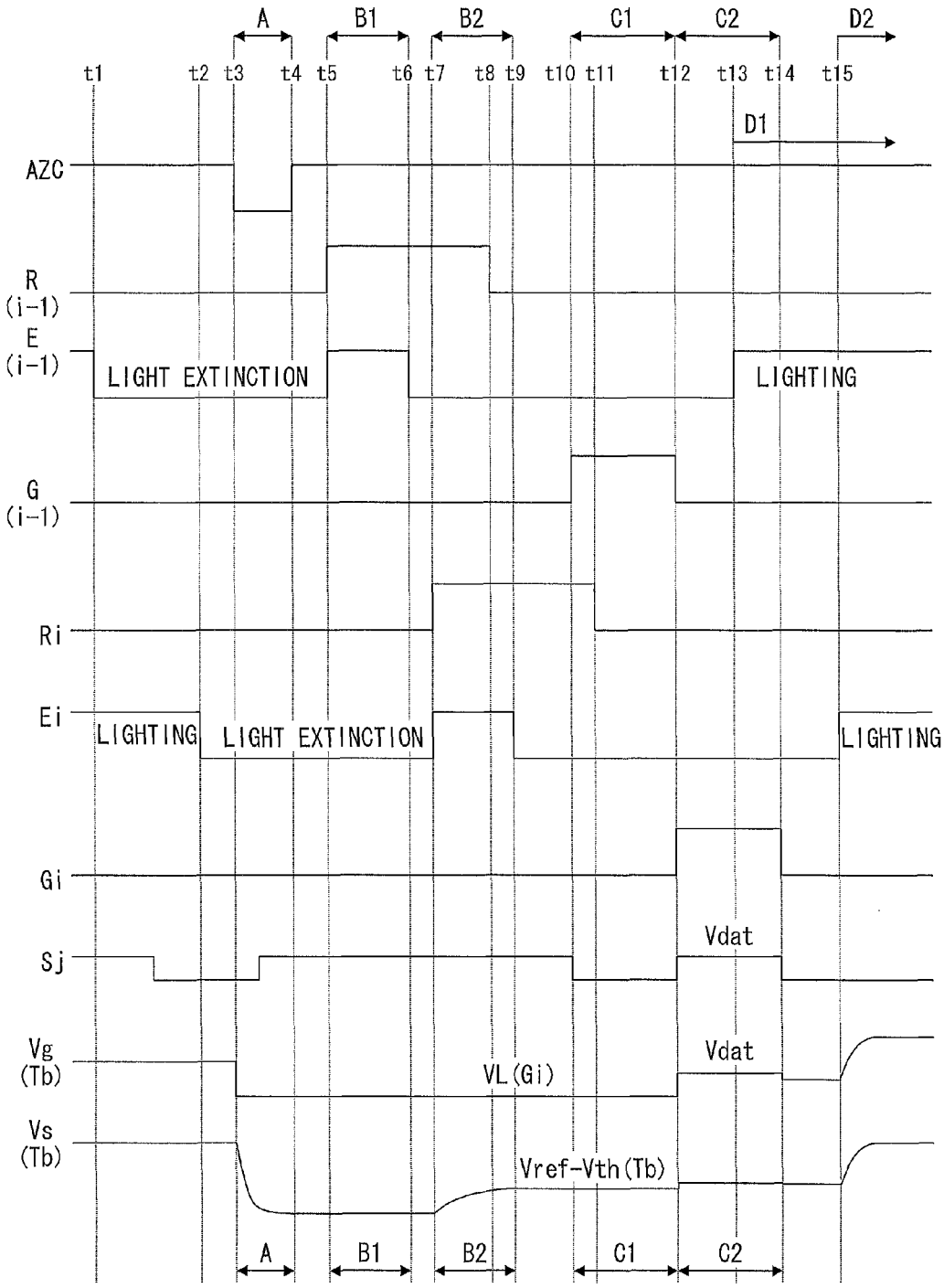
FIG. 9 is a timing chart showing a method for driving the pixel array shown in FIG. 8.

FIG. 9 shows a method for driving the pixel array substrate PAS in which pixel circuits as shown in FIG. 8 are provided. In FIG. 9, (i) AZC indicates an electric potential of the second control line AZC commonly shared by the $(i-1)^{th}$ and $i^{th}$ horizontal pixel rows, (ii) R(i−1) indicates an electric potential of the third control line R(i−1) of the $(i-1)^{th}$ horizontal pixel row, (iii) E(i−1) indicates an electric potential of the first control line E(i−1) of the $(i-1)^{th}$ horizontal pixel row, (iv) G(i−1) indicates an electric potential of the scanning line G(i−1) of the $(i-1)^{th}$ horizontal pixel row, (v) Ri indicates an electric potential of the third control line Ri of the $i^{th}$ horizontal pixel row, (vi) Gi indicates an electric potential of the control line Gi of the $i^{th}$ horizontal pixel row, (vii) Sj indicates an electric potential of the data line Gj, (viii) Vg(Tb) indicates a gate electric potential of the transistor Tb in the $i^{th}$ horizontal pixel row, and (ix) Vs(Tb) indicates a source electric potential of the transistor Tb in the $i^{th}$ horizontal pixel row.

Operations between t1 and t4 are similar to respective operations between t1 and t4 described in FIG. 3.

Both of the first control line E(i−1) and the third control line R(i−1) of the $(i-1)^{th}$ horizontal pixel row are changed from "Low" to "High" at t5. This starts a period B1 within which a threshold value of the drive transistor in the $(i-1)^{th}$ horizontal pixel row is detected. Then, the first control line E(i−1) of the $(i-1)^{th}$ horizontal pixel row is changed from "High" to "Low" at t6. This ends the period B1.

Both of the first control line Ei and the third control line Ri of the $i^{th}$ horizontal pixel row are changed from "Low" to "High" at t7. This starts a period B2 within which a threshold value of the drive transistor (Tb) is detected. As such, the transistor Te are being turned ON during the period B2 so that a gate electric potential Vg(Tb) of the transistor Tb becomes Vl(Gi) which is a "Low (inactive)" electric potential of the scanning line Gi of the $i^{th}$ horizontal pixel row.

Note, here, that VL(Gi) is set to such a value that the following mathematical expressions (7) and (8) are satisfied:

$$VL(Gi)>VL(AZ)+Vth(Tc)+Vth(Tb) \quad (7);$$

and $$VL(Gi)<Vth(EL)+Vth(Tb) \quad (8),$$

where Vth(Tb) is a threshold electric potential of the transistor Tb and Vth(Tc) is an electric potential of the transistor Tc.

As such, although the transistor Tb is turned ON within the period B2, a current is prevented from flowing through the organic EL element OEL. This causes a source electric potential of the transistor Tb (the anode electric potential of the organic EL element OEL) to be increased from Vss by a current supplied from the first power supply line Ypj. Then, the transistor Tb is turned OFF after the source electric potential Vs of the transistor Tb is increased so that Vs(Tb)=Vref−Vth(Tb).

Then, the third control line R(i−1) of the$(i-1)^{th}$ horizontal pixel row is changed from "High" to "Low" at t8. Then, the first control line Ei of the $i^{th}$ horizontal pixel row is changed from "High" to "Low" at t9. This ends the period B2. Operations between t10 and t15 (which corresponds to periods C1, C2, D1, and D2) are similar to respective operations between t10 and t15 described in FIG. 3.

The display device of Embodiment 3 brings about a merit same as the merit described in Embodiment 2 and another merit that the number of power supply lines can be further decreased. This can improve an aperture ratio and decrease parasitic capacitance formed between each power supply line and a corresponding line (for example, a data line) intersecting with that power supply line. Further, short-circuit between each power supply line and the corresponding line intersecting with that power supply line is reduced so that a yield ratio (that is, productivity) can be improved. Furthermore, decreasing of the number of power supply lines can cause a decrease in the number of power supply circuits in each driver.

Embodiment 4

Figure 10:
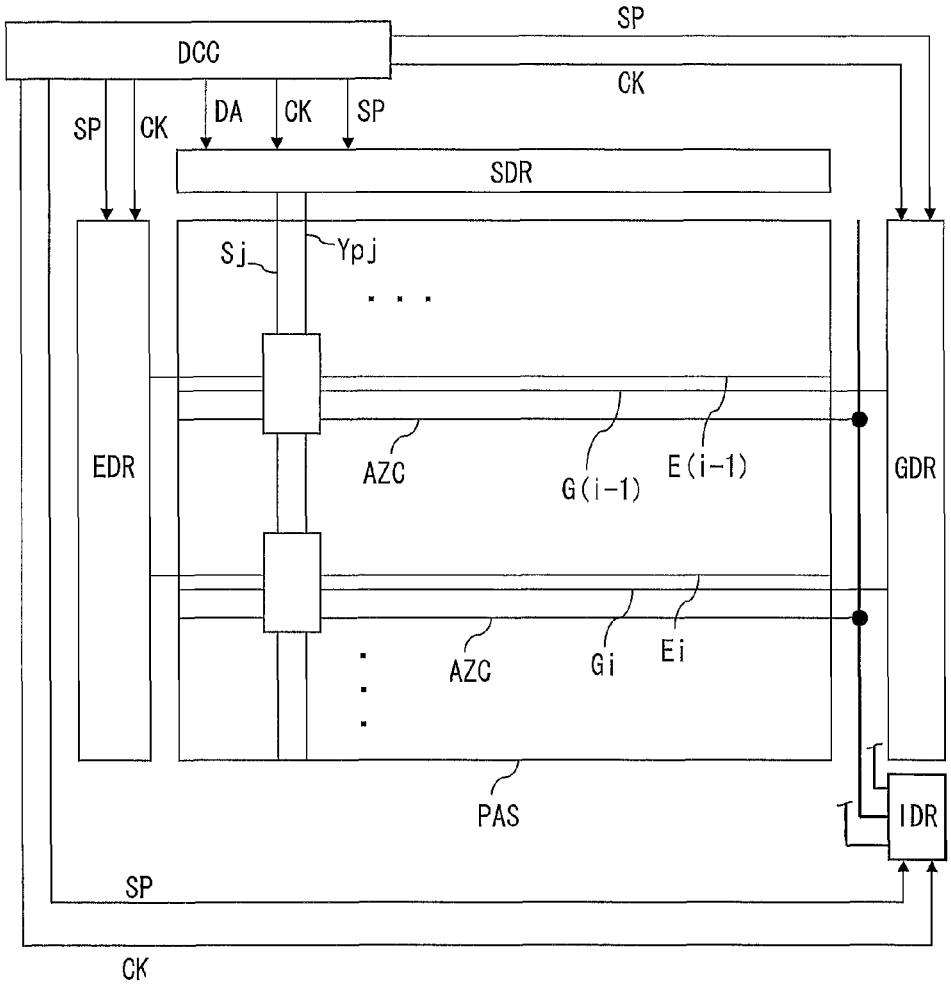
FIG. 10 is a view schematically showing how a present display device is configured in accordance with Embodiment 4.

FIG. 10 is a block view showing a configuration of a display device in accordance with Embodiment 4. As shown in FIG. 10, the display device includes a pixel array substrate PAS, a display control circuit DCC, a light-emitting driver EDR, a gate driver GDR, an initialization driver IDR, and a source driver SDR. The pixel array substrate PAS includes wiring lines in which, for example, (i) a first power supply line Ypj and a data line Sj are provided for a $j^{th}$ longitudinal pixel row, (ii) a first control line Ei and a scanning line Gi are provided for an $i^{th}$ horizontal pixel row, and (iii) a second control line AZC is commonly shared by $(i-1)^{th}$ and $i^{th}$ horizontal pixel rows.

The gate driver GDR drives the scanning line Gi in accordance with a clock pulse CK and a start pulse SP received from the display control circuit DCC. The source driver SDR drives the data line Sj and the first power supply line Ypj in accordance with a clock signal CK and a start pulse SP received from the display control circuit DCC. The light-emitting driver EDR drives the first control line Ei in accordance with a clock signal CK and a start pulse SP received from the display control circuit DCC. The initialization driver IDR drives the second control line AZC in accordance with a clock signal CK and a start pulse SP received from the display control circuit DCC. Note that the light-emitting driver EDR is mounted or monolithically provided so as to extend along one side of a rectangular shape of the pixel array substrate PAS, the gate driver GDR is mounted or monolithically provided so as to extend along that side of the rectangular shape of the pixel array substrate PAS which is opposite to the one side, and the initialization driver IDR is mounted or monolithically provided near a corner of the rectangular shape of the pixel array substrate PAS so as to be adjacent to the gate driver GDR. Obviously, both of the light-emitting driver EDR and the gate drivers GDR can be mounted or monolithically provided so as to extend along one side of the rectangular shape of the pixel array substrate PAS (see FIG. 15).

Figure 11:
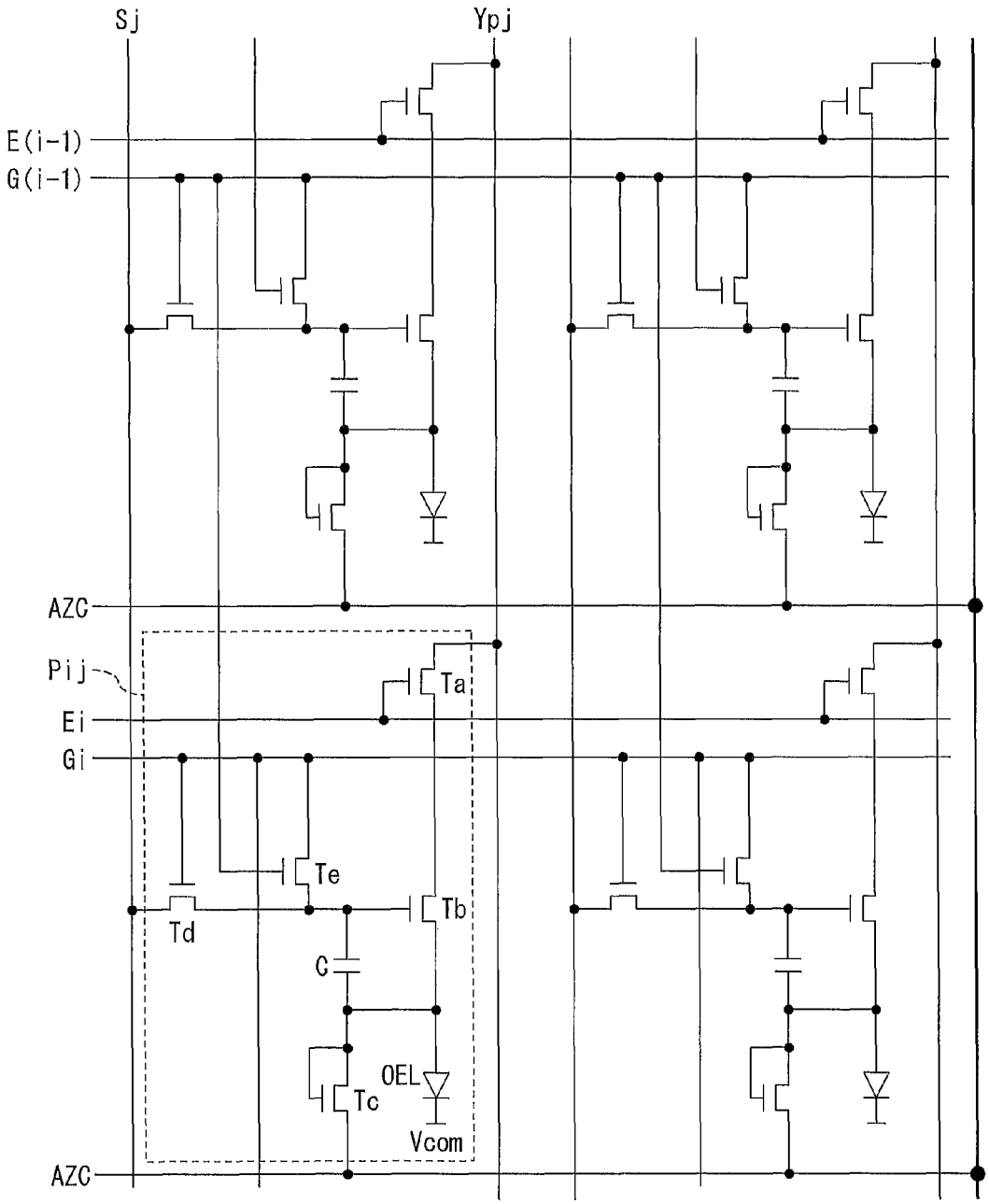
FIG. 11 is a circuit view partially showing a configuration of a pixel array (four pixels) is arranged in accordance with Embodiment 4.

FIG. 11 partially shows a configuration of the pixel array substrate (four pixel circuits) in accordance with Embodiment 4. As shown in FIG. 11, an organic EL element OEL, five n-channel transistors (filed-effect transistors) Ta through Te, and a capacitor C are provided in a pixel circuit Pij provided at an intersection of the $i^{th}$ horizontal pixel row and the $j^{th}$ longitudinal pixel row.

Note, here, that (i) a gate terminal of the transistor Ta is connected to a first control line Ei, (ii) a gate terminal of the transistor Td is connected to a scanning line Gi, (iii) a gate terminal of the transistor Te is connected to a scanning line G(i−1) of the $(i-1)^{th}$ horizontal pixel row immediately followed by the $i^{th}$ horizontal pixel row, (iv) a gate terminal of the transistor Tb (driver transistor) is connected to a data line Sj via the transistor Td and to a scanning line Gi of the $i^{th}$ horizontal pixel row via the transistor Te, (v) a drain terminal of the transistor Tb is connected to a first power supply line Ypj via the transistor Ta, (vi) the capacitor C is provided between the gate terminal and a source terminal of the transistor Tb, (vii) the source terminal of Tb is connected to an anode of the organic EL element OEL and to the second control line AZC, which is commonly shared by pixels of the $(i-1)^{th}$ horizontal pixel row and the $i^{th}$ horizontal pixel row which is immediately downstream to the $(i-1)^{th}$ horizontal pixel row, via the transistor Tc, (viii) a cathode of the organic EL element OEL is connected to Vcom, and (ix) the gate terminal and the drain terminal of the transistor Tc are connected to each other. That is, in the pixel circuit, the gate terminal and the drain terminal of the transistor Tc are connected to the anode of the organic EL element OEL, and the source terminal of the transistor Tc is connected to the second control line AZC.

Figure 12:
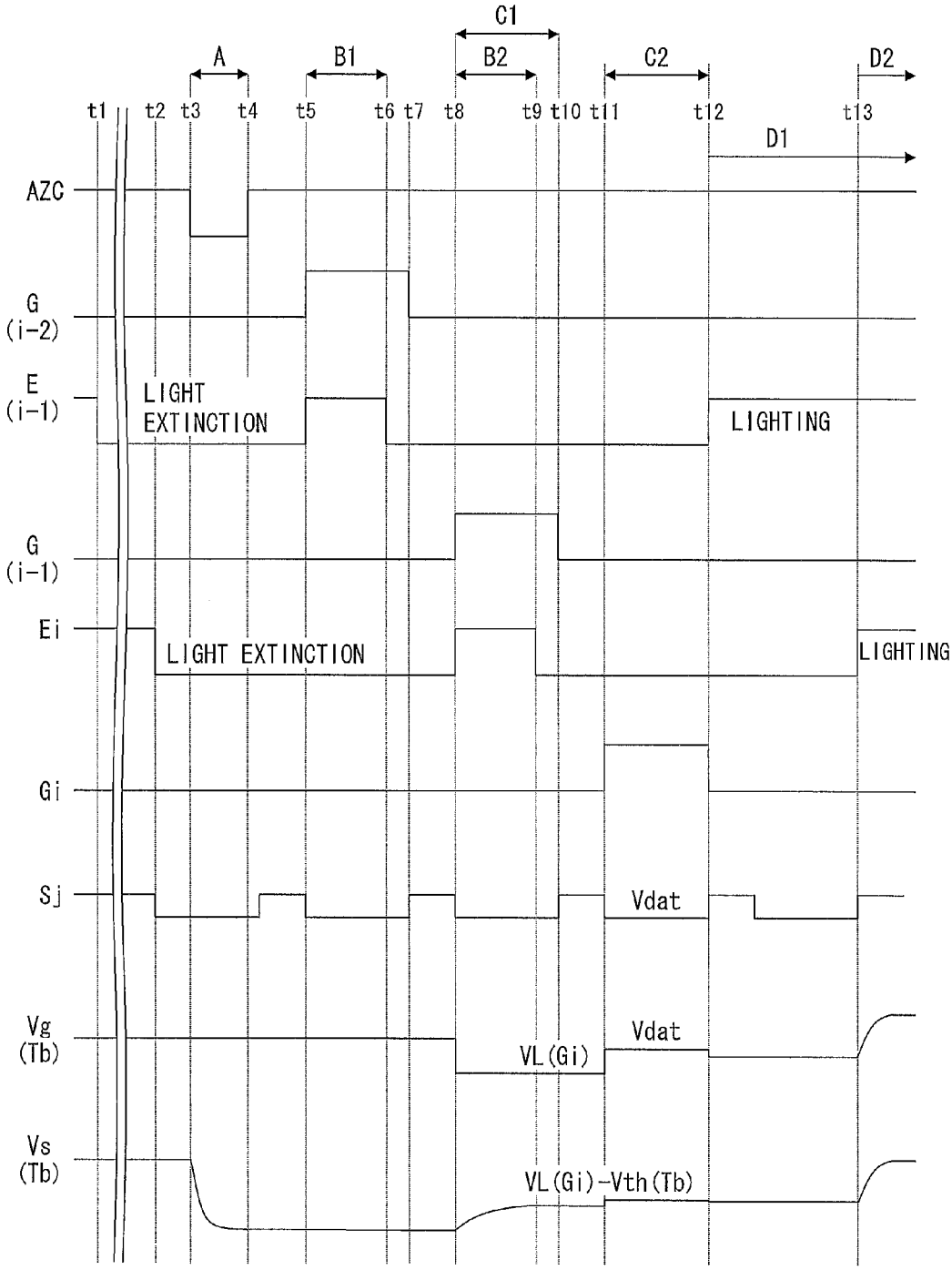
FIG. 12 is a timing chart showing a method for driving the pixel array shown in FIG. 11.

FIG. 12 shows a method for driving the pixel array substrate PAS in which pixel circuits as shown in FIG. 11 are provided. In FIG. 12, (i) AZC indicates an electric potential of the second control line AZC commonly shared by the $(i-1)^{th}$ and $i^{th}$ horizontal pixel rows, (ii) E(i−1) indicates an electric potential of the first control line E(i−1) of the $(i-1)^{th}$ horizontal pixel row, (iii) G(i−1) indicates an electric potential of the scanning line G(i−1) of the $(i-1)^{th}$ horizontal pixel row, (iv)

Gi indicates an electric potential of the scanning line Gi of the $i^{th}$ horizontal pixel row, (v) Sj indicates an electric potential of the data line Sj, (vi) Vg(Tb) indicates a gate electric potential of the transistor Tb in the $i^{th}$ horizontal pixel row, and (vii) Vs(Tb) indicates a source electric potential of the transistor Tb in the $i^{th}$ horizontal pixel row.

Operations between t1 and t4 are similar to the respective operations between t1 and t4 described in FIG. 3.

Both of the first control line E(i−1) of the $(i-1)^{th}$ horizontal pixel row and a scanning line G(i−2) of a further horizontal pixel row immediately followed by the $(i-1)^{th}$ horizontal pixel row are changed from "Low" to "High" at t5. This starts a period B1 within which a threshold value of the drive transistor in the $(i-1)^{th}$ horizontal pixel row is detected. Then, the first control line E(i−1) of the $(i-1)^{th}$ horizontal pixel row is changed from "High" to "Low" at t6. This ends the period B1. Then, a scanning line G(i−2) of the further horizontal pixel row is changed from "High" to "Low" at t7.

Then, both of the scanning line G(i−1) of the $(i-1)^{th}$ horizontal pixel row and the first control line Ei of the $i^{th}$ horizontal pixel row are changed from "Low" to "High" at t8. This concurrently starts a period B2 and a period C1, where the period B2 is a period within which a threshold value of the drive transistor (Tb) in the $i^{th}$ horizontal pixel row is detected and the period C1 is a data writing period of the $(i-1)^{th}$ horizontal pixel row. As such, during the period B2, the gate electric potential Vg(Tb) of the transistor Tb are being VL(Gi) which is a "Low (inactive)" electric potential of the scanning line Gi of the $i^{th}$ horizontal pixel row.

Note, here, that VL(Gi) is set similarly to VL(Gi) of Embodiment 3. As such, a source electric potential of the transistor Tb (=anode electric potential of the organic EL element OEL) is increased from Vss by a current supplied via the first power supply line Ypj. Then, the transistor Tb is turned OFF after the source electric potential Vs(Tb) of the transistor Tb is increased so that Vs(Tb)=Vref−Vth(Tb).

Then, the first control line Ei of the $i^{th}$ horizontal pixel row is changed from "High" to "Low" at t9. This ends the period B2. After this, the scanning line G(i−1) of the $(i-1)^{th}$ horizontal pixel row is changed from "High" to "Low" at t10. This ends the period C1 which is the data writing period of the $(i-1)^{th}$ horizontal pixel row. Note that operations between the periods C2, D1, and D2 are similar to the respective corresponding operations described in Embodiment 3 (FIG. 9).

The display device of Embodiment 4 brings about a merit same as the merit described in Embodiment 3 and another merit that a third control line can be omitted. This eliminates the necessity for a correction driver RDR. In the pixel array substrate, a higher aperture ratio can be achieved and there is less parasitic capacitance formed between each third control line and a corresponding line (for example, a data line) intersecting with that third control line. Also, third control lines and respective corresponding lines intersecting with them are short-circuited less so that a higher yield ratio (that is, a higher productivity) can be achieved.

Embodiment 5

Figure 13:
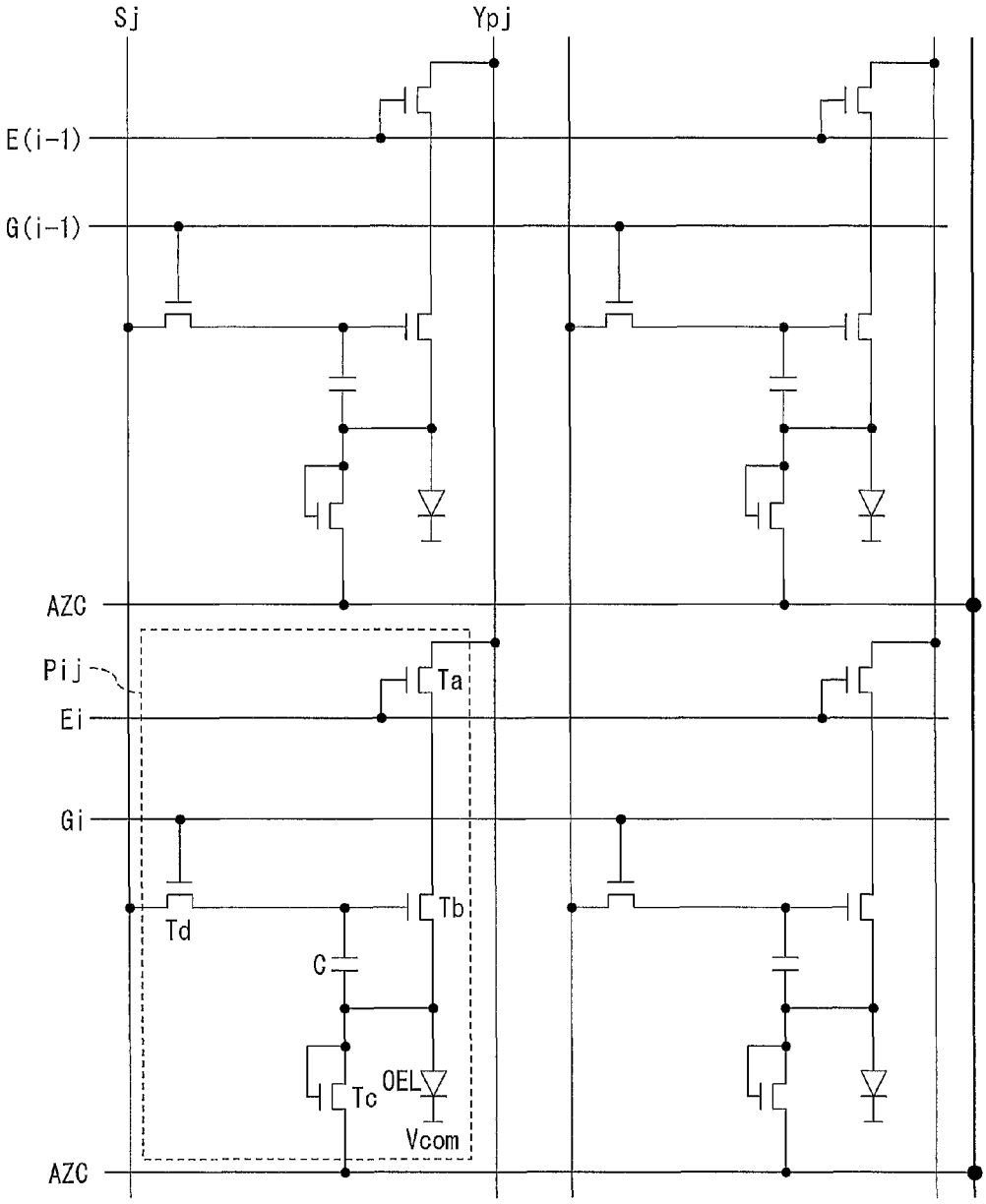
FIG. 13 is a circuit view partially showing a configuration of a pixel array (four pixels) in accordance with Embodiment 5.

A display device of Embodiment 5 is configured similarly to the display device of Embodiment 4 shown in FIG. 10. FIG. 13 partially shows a configuration of a pixel array substrate (four pixel circuits) in accordance with Embodiment 5. As shown in FIG. 13, an organic EL element OEL, four n-channel transistors Ta through Td, and a capacitor C are provided in a pixel circuit Pij provided at an intersection of an $i^{th}$ horizontal pixel row and a $j^{th}$ longitudinal pixel row.

Note, here, that (i) a gate terminal of the transistor Ta is connected to a first control line Ei, (ii) a gate terminal of the transistor Td is connected to a scanning line Gi of the $i^{th}$ horizontal pixel row, (iii) a gate terminal of the transistor Tb (drive transistor) is connected to a data line Sj via the transistor Td, (iv) a drain terminal of the transistor Tb is connected to a first power supply line Ypj via the transistor Ta, (v) the capacitor C is provided between the gate terminal and a source terminal of the transistor Tb, (vi) the source terminal of the transistor Tb is connected to an anode of the organic EL element OEL and to a second control line AZC, which is commonly shared by pixels of the $i^{th}$ horizontal pixel row and an $(i-1)^{th}$ horizontal pixel row immediately upstream to the $i^{th}$ horizontal pixel row, via the transistor Tc (vii) a cathode of the organic EL element OEL is connected to Vcom, and (ix) the gate terminal and the drain terminal of the transistor Tc are connected to each other. That is, in each of the pixel circuits, the gate terminal and the drain terminal of the transistor Tc are connected to the anode of the organic EL element OEL, and the source terminal of the transistor Tc is connected to the second control line AZC.

Figure 14:
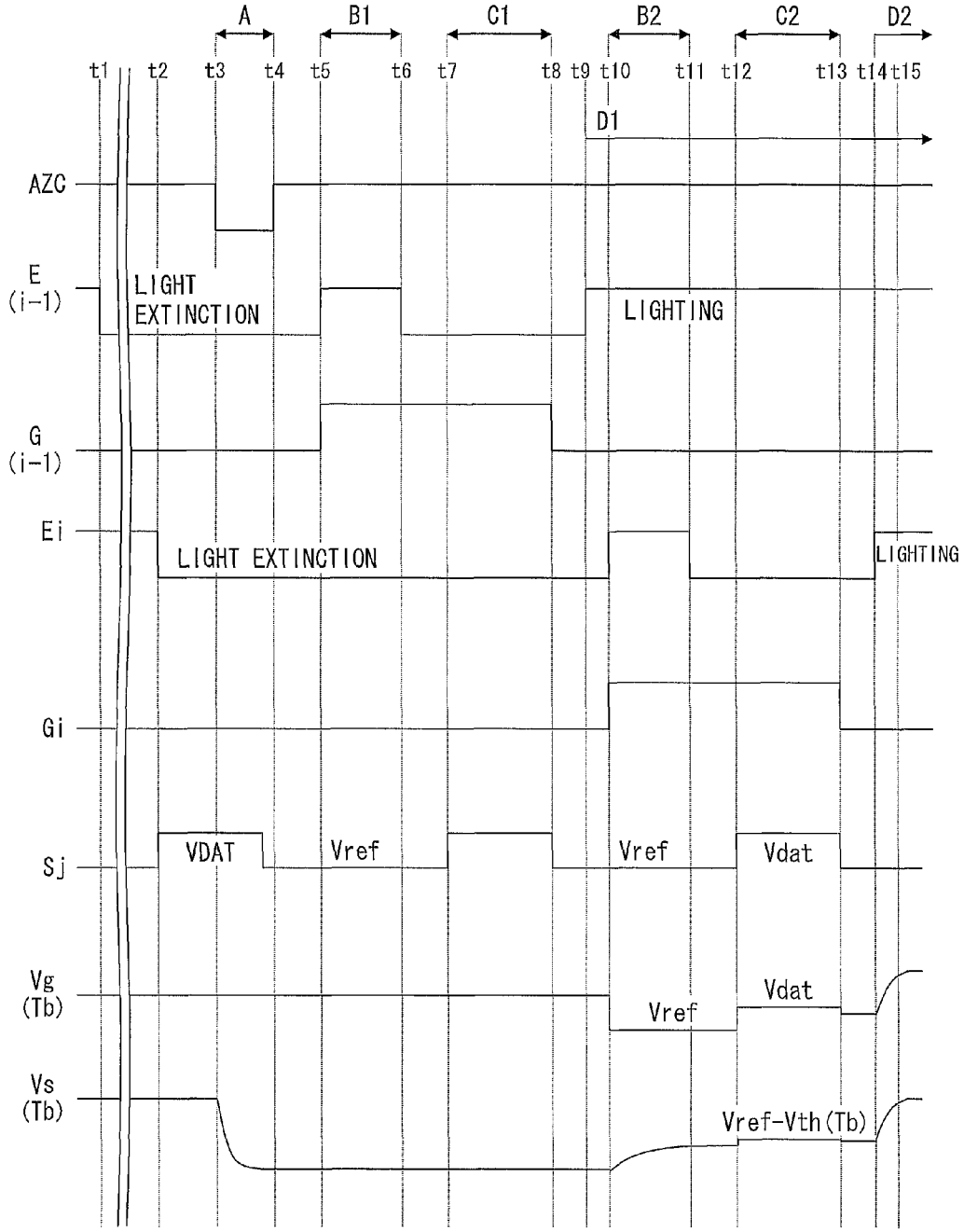
FIG. 14 is a timing chart showing a method for driving the pixel array shown in FIG. 13.
Figure 15:
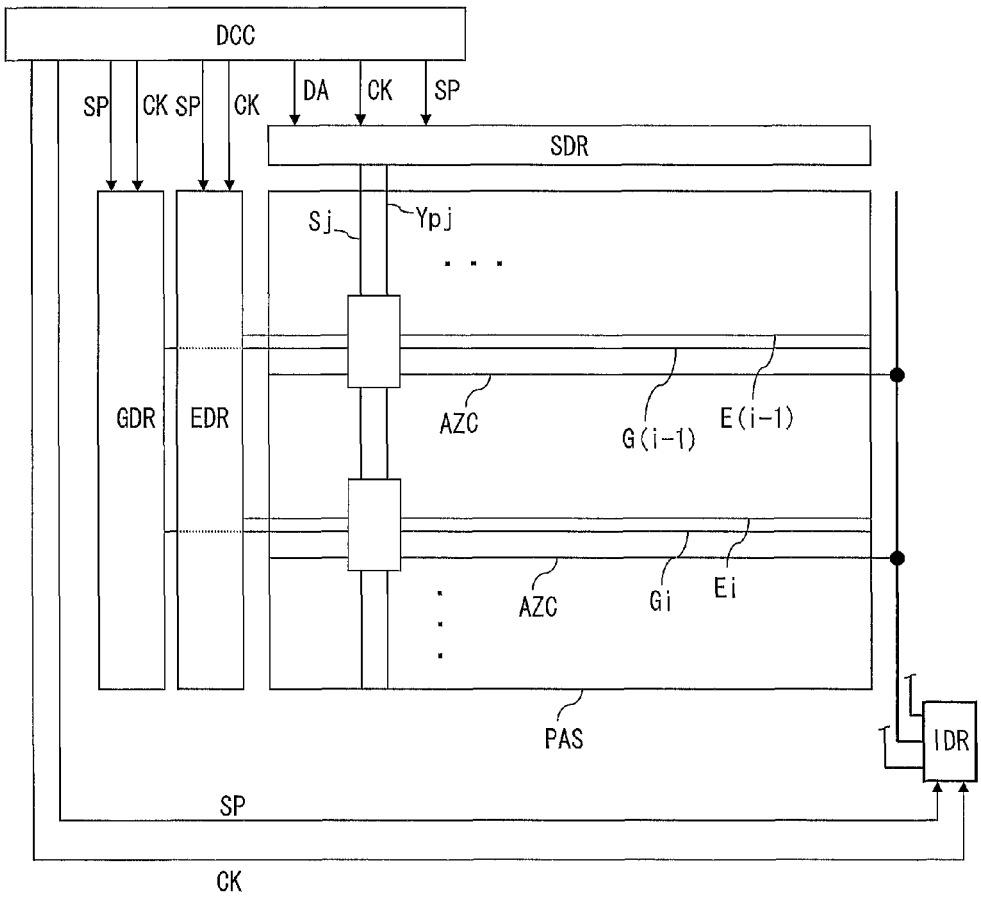
FIG. 15 is a view schematically showing how a present display device is alternatively configured in accordance with Embodiment 4.

FIG. 14 shows a method for driving the pixel array substrate PAS in which pixel circuits as shown in FIG. 13 are provided. In FIG. 14, (i) AZC indicates an electric potential of the second control line AZC shared by the $(i-1)^{th}$ and $i^{th}$ horizontal pixel rows, (ii) E(i−1) indicates an electric potential of the first control line E(i−1) of the $(i-1)^{th}$ horizontal pixel row, (iii) G(i−1) indicates an electric potential of the scanning line G(i−1) of the $(i-1)^{th}$ horizontal pixel row, (iv) Gi indicates an electric potential of the scanning line Gi of the $i^{th}$ horizontal pixel row, (v) Sj indicates an electric potential of the data line Sj, (vi) Vg(Tb) indicates a gate electric potential of the transistor Tb in the $i^{th}$ horizontal pixel row, and (vii) Vs(Tb) indicates a source electric potential of the transistor Tb in the $i^{th}$ horizontal pixel row.

Operations between t1 and t4 are similar to the respective corresponding operations described in FIG. 3.

Both of the first control line E(i−1) and the scanning line G(i−1) of the $(i-1)^{th}$ horizontal pixel row are changed from "Low" to "High" at t5. This starts a period B1 within which a threshold value of the drive transistor in the $(i-1)^{th}$ horizontal pixel row is detected. Then, the first control line E(i−1) is changed from "High" to "Low" at t6. This ends the period B1.

Then, a period C1, which is a data writing period of the $(i-1)^{th}$ horizontal pixel row, is started at t7. Then, the scanning line G(i−1) of the $(i-1)^{th}$ horizontal pixel row is changed from "High" to "Low" at t8. This ends the period C1. Then, the first control line E(i−1) of the $(i-1)^{th}$ horizontal pixel row is changed from "Low" to "High" at t9. This starts a period D1 during which the organic EL element OEL in the $(i-1)^{th}$ horizontal pixel row is emitting light.

Then, both of the first control line Ei and the scanning signal line Gi of the $i^{th}$ horizontal pixel row are changed from "Low" to "High" at t10. This starts a period B2 within which a threshold value of the drive transistor (Tb) in the $i^{th}$ horizontal pixel row is detected. As such, a reset electric potential Vref is being supplied to the data line Sj during the period B2. This causes a gate electric potential Vg(Tb) of the transistor Tb to become Vref.

Note, here, that Vref is set similarly to Vref of Embodiment 1. As such, a source electric potential of the transistor Tb (=an anode electric potential of the organic EL element OEL) is increased from Vss by a current supplied from the first power supply line Ypj. Then, transistor Tb is turned OFF after the source electric potential Vs(Tb) of the transistor Tb is increased so that Vs(Tb)=vref−Vth(Tb).

Then, the first control line Ei of the $i^{th}$ horizontal pixel row is changed from "High" to "Low" at t11. This ends the period B2.

Then, the scanning line Gi of the $i^{th}$ horizontal pixel row is being held to "High" during t12. This starts a period C2 which is a data writing period. As such, a data signal electric potential Vdat is being written into the gate terminal of the transistor Tb from the data line Sj during the period C2. This causes Vg(Tb)=Vdat. Note that operations during the period D2 are similar to corresponding operations described in FIG. 3.

The pixel array substrate of Embodiment 5 brings about a merit same as the merit described in Embodiment 4 and another merit that the required numbers of respective of the transistors and wiring lines in a pixel circuit can be decreased. As such, the display device of Embodiment 5 is suitable for a small and high-definition display in particular.

The present invention is not limited to the description of each of Embodiments 1 through 5. An embodiment derived from modifying of the embodiments as appropriate based on technical common knowledge and an embodiment derived from a proper combination of different embodiments are also encompassed in the technical scope of the present invention.

A display device of the present invention includes: pixels, each of which is provided with first to fourth transistors, and a light-emitting element, each pixel being configured such that a control terminal of the first transistor is connected to a first control line, a control terminal of the fourth transistor is connected to a scanning line, a first electrically-conductive terminal of the fourth transistor is connected to a data line, a first electrically-conductive terminal of the second transistor is connected to a first power supply line via the first transistor, a control terminal of the second transistor is connected to the data line via the fourth transistor and to a terminal of the light-emitting element via a capacitor, the terminal of the light-emitting element, a second electrically-conductive terminal of the second transistor, a first electrically-conductive terminal of the third transistor, and a control terminal of the third transistor are connected to each other; and a second control line shared commonly by at least two pixels among the pixels, the at least two pixels being such that the fourth transistors of the at least two pixels are connected to different scanning lines, and second electrically-conductive terminals of the third transistors of the at least two pixels are connected to the second control line, the at least two pixels being such that the third transistors of the at least two pixels are concurrently turned ON, after the first transistors of the at least two pixels are sequentially turned OFF.

In the display device, lighting periods in horizontal pixel rows (that is, pixels) can be set to same timings and each second control line can be shared by two or more horizontal pixel rows. This makes it possible that required number of second control lines necessary to be independently driven (and required number of outputs for the respective second control lines) is decreased to fewer than that in a conventional arrangement (see FIG. 16), and that driver circuits are simplified in arrangement and decreased in size. This can make mounting of the driver circuits easier and requires less drawing around of lines, so that improved productivity can be achieved.

Further, in the display device, the third transistor is diode-connected so that required number of power supply lines can be decreased to fewer than that in the conventional arrangement (see FIG. 16).

A display device of the present invention includes: pixels, each of which is provided with first to fourth transistors, and a light-emitting element, each pixel being configured so that a control terminal of the first transistor is connected to a first control line, a control terminal of the fourth transistor is connected to a scanning line, a first electrically-conductive terminal of the fourth transistor is connected to a data line, a first electrically-conductive terminal of the second transistor is connected to a first power supply line via the first transistor, a first electrically-conductive terminal of the third transistor is connected to an initialization electric potential supply line, a control terminal of the second transistor is connected to the data line via the fourth transistor and to a terminal of the light-emitting element via a capacitor, and the terminal of the light-emitting element, a second electrically-conductive terminal of the second transistor, and a second electrically-conductive terminal of the third transistor are connected to one other; and a second control line shared commonly by at least two pixels among the pixels, the at least two pixels being such that the fourth transistors of the at least two pixels are connected to different scanning lines, and control terminals of the third transistors of the at least two pixels are connected to the second control line, the at least two pixels being such that the third transistors of the at least two pixels are concurrently turned ON, after the first transistors of the at least two pixels are sequentially turned OFF.

In the present display device, lighting periods in horizontal pixel rows (that is, pixels) can be started at same timings and each second control line can be shared commonly by two or more horizontal pixel rows. As such, required number of second control lines necessary to be independently driven (and required number of outputs for the respective second control lines) is decreased to fewer than that in a conventional arrangement (see FIG. 16), so that driver circuits are simplified in configuration and decreased in size. This can make mounting of the driver circuits easier and requires less drawing around of wiring lines, so that improved productivity can be achieved.

The display device may be configured such that a terminal electric potential of the light-emitting element is initialized by preventing a current from flowing through the light-emitting element while the third transistor is turned ON.

The display device may be configured such that a threshold value of the second transistor is detected by switching the second transistor from ON to OFF, (a) after initializing of the terminal electric potential of the light-emitting element and turning OFF of the third transistor, and (b) in a condition that the first transistor is turned ON, a predetermined electric potential is supplied to the control terminal of the second transistor, and a current is prevented from flowing through the light-emitting element.

The display device may be configured such that: each pixel is further provided with a fifth transistor having a first electrically-conductive terminal connected to the control terminal of the second transistor; and the display device further includes a second power supply line which is connected to a second electrically-conductive terminal of the fifth transistor and via which the predetermined electric potential is supplied.

The display device may be configured such that the predetermined electric potential is supplied from the data line via the fourth transistor.

The display device may be configured such that a data signal electric potential is written into the control terminal of the second transistor from the data line via the fourth transistor, after the threshold value of the second transistor is detected and the first transistor is turned OFF.

The display device may be configured such that the first transistor is turned ON after the data signal electric potential is written into the control terminal of the second transistor, so that the current flows through the light-emitting element from the first power supply line via the first transistor and the second transistor.

The display device may be configured such that the first through fourth transistors are n-channel field-effect transistors.

The display device may be configured such that the third transistor is an enhanced field-effect transistor having a threshold value of larger than a ground electric potential.

The display device may be configured such that each pixel is further provided with a fifth transistor having a first electrically-conductive terminal connected to the control terminal of the second transistor.

The display device may further include: a second power supply line connected to a second electrically-conductive terminal of the fifth transistor; and a third control line connected to a control terminal of the fifth transistor.

The display device may further include a third control line being connected to a control terminal of the fifth transistor, the fifth transistor having a second electrically-conductive terminal being connected to the scanning line associated with a pixel row to which the pixel to which the fifth transistor is provided belongs.

The display device may be configured such that: a control terminal of the fifth transistor is connected to a scanning line associated with a pixel row immediately preceding a pixel row to which the pixel to which the fifth transistor is provided belongs; and a second electrically-conductive terminal of the fifth transistor is connected to the scanning line associated with the pixel row to which the pixel to which the fifth transistor is provided belongs.

The display device may be configured such that the light-emitting element is an organic light-emitting diode.

The display device may further include a pixel array substrate having a rectangular shape, a driving circuit for driving the second control line being mounted or monolithically provided near a corner of the rectangular shape of the pixel array substrate.

The display device may be configured such that: a driving circuit for driving the scanning line is mounted or monolithically provided so as to extend along one side of the rectangular shape of the pixel array substrate; and a driving circuit for driving the first control line is mounted or monolithically provided so as to extend along that side of the rectangular shape of the pixel array substrate which is opposite to the one side.

The display device may be configured such that the driving circuit for driving the scanning line and the driving circuit for driving the first control line are mounted or monolithically provided so as to extend along one side of the rectangular shape of the pixel array substrate.

A method of the present invention for driving a display device, the display device including: pixels, each of which is provided with first to fourth transistors, and a light-emitting element, each pixel being configured so that a control terminal of the first transistor is connected to a first control line, (ii) a control terminal of the fourth transistor is connected to a scanning line, (iii) a first electrically-conductive terminal of the fourth transistor is connected to a data line, (iv) a first electrically-conductive terminal of the second transistor is connected to a first power supply line via the first transistor, (v) a control terminal of the second transistor is connected to the data line via the fourth transistor and to a terminal of the light-emitting element via a capacitor, and (vi) the terminal of the light-emitting element, a second electrically-conductive terminal of the second transistor, and a first electrically-conductive terminal, and the control terminal of the third transistor are connected to each other; and a second control line shared commonly by at least two pixels among the pixels, the at least two pixels being such that second electrically-conductive terminals of the third transistors of the at least two pixels are connected to the second control line, the method comprising the step of concurrently turning ON the third transistors of the at least two pixels, after sequentially turning OFF the first transistors of the at least two pixels

INDUSTRIAL APPLICABILITY

The present pixel array substrate and the present display device are suitable for use in an organic EL display, for example.

REFERENCE SIGNS LIST

OEL: organic EL element (organic light-emitting diode)
Ta through Te: transistors (first through fifth transistors)
C: capacitor
Gi: scanning line
Sj: data line
Ypj: first power supply line
Xpi: second power supply line
Xqi: initialization electric potential supply line
Ei: first control line
AZC: (shared) second control line
Ri: third control line

The invention claimed is:

1. A display device, comprising:

a light-emitting element;

pixels, each of which is provided with first to fourth transistors and configured such that a control terminal of the first transistor is connected to a first control line, a control terminal of the fourth transistor is connected to a scanning line, a first electrically-conductive terminal of the fourth transistor is connected to a data line, a first electrically-conductive terminal of the second transistor is connected to a first power supply line via the first transistor, a control terminal of the second transistor is connected to the data line via the fourth transistor and to a terminal of the light-emitting element via a capacitor, the terminal of the light-emitting element, a second electrically-conductive terminal of the second transistor, a first electrically-conductive terminal of the third transistor, and a control terminal of the third transistor are connected to each other; and a second control line shared commonly by at least two pixels among the pixels, the at least two pixels being such that the fourth transistors of the at least two pixels are connected to different scanning lines, and second electrically-conductive terminals of the third transistors of the at least two pixels are connected to the second control line, the at least two pixels being such that the third transistors of the at least two pixels are concurrently turned ON, after the first transistors of the at least two pixels are sequentially turned OFF.

2. A display device, comprising:

a light-emitting element;

pixels, each of which is provided with first to fourth transistors and configured so that a control terminal of the first transistor is connected to a first control line, a control terminal of the fourth transistor is connected to a scanning line, a first electrically-conductive terminal of the fourth transistor is connected to a data line, a first electrically-conductive terminal of the second transistor is connected to a first power supply line via the first transistor, a first electrically-conductive terminal of the third transistor is connected to an initialization electric potential supply line, a control terminal of the second transistor is connected to the data line via the fourth transistor and to a terminal of the light-emitting element via a capacitor, and the terminal of the light-emitting element, a second electrically-conductive terminal of the second transistor, and a second electrically-conductive terminal of the third transistor are connected to one other; and a second control line shared commonly by at least two pixels among the pixels, the at least two pixels being such that the fourth transistors of the at least two pixels are connected to different scanning lines, and control terminals of the third transistors of the at least two pixels are connected to the second control line, the at least two pixels being such that the third transistors of the at least two pixels are concurrently turned ON, after the first transistors of the at least two pixels are sequentially turned OFF.

3. The display device as set forth in claim 1, wherein a terminal electric potential of the light-emitting element is initialized by preventing a current from flowing through the light-emitting element while the third transistor is turned ON.

4. The display device as set forth in claim 3, wherein a threshold value of the second transistor is detected by switching the second transistor from ON to OFF, (a) after initializing of the terminal electric potential of the light-emitting element and turning OFF of the third transistor, and (b) in a condition that the first transistor is turned ON, a predetermined electric potential is supplied to the control terminal of the second transistor, and a current is prevented from flowing through the light-emitting element.

5. The display device as set forth in claim 4, wherein:

each pixel is further provided with a fifth transistor having a first electrically-conductive terminal connected to the control terminal of the second transistor; and the display device further includes a second power supply line which is connected to a second electrically-conductive terminal of the fifth transistor and via which the predetermined electric potential is supplied.

6. The display device as set forth in claim 4, wherein the predetermined electric potential is supplied from the data line via the fourth transistor.

7. The display device as set forth in claim 4, wherein a data signal electric potential is written into the control terminal of the second transistor from the data line via the fourth transistor, after the threshold value of the second transistor is detected and the first transistor is turned OFF.

8. The display device as set forth in claim 7, wherein the first transistor is turned ON after the data signal electric potential is written into the control terminal of the second transistor, so that the current flows through the light-emitting element from the first power supply line via the first transistor and the second transistor.

9. The display device as set forth in claim 1, wherein the first through fourth transistors are n-channel field-effect transistors.

10. The display device as set forth in claim 1, wherein the third transistor is an enhanced field-effect transistor having a threshold value of larger than a ground electric potential.

11. The display device as set forth in claim 1, wherein each pixel is further provided with a fifth transistor having a first electrically-conductive terminal connected to the control terminal of the second transistor.

12. A display device as set forth in claim 11, further comprising:

a second power supply line connected to a second electrically-conductive terminal of the fifth transistor; and a third control line connected to a control terminal of the fifth transistor.

13. A display device as set forth in claim 11, further comprising a third control line being connected to a control terminal of the fifth transistor, the fifth transistor having a second electrically-conductive terminal being connected to the scanning line associated with a pixel row to which the pixel to which the fifth transistor is provided belongs.

14. The display device as set forth in claim 11, wherein a control terminal of the fifth transistor is connected to a scanning line associated with a pixel row immediately preceding a pixel row to which the pixel to which the fifth transistor is provided belongs; and a second electrically-conductive terminal of the fifth transistor is connected to the scanning line associated with the pixel row to which the pixel to which the fifth transistor is provided belongs.

15. The display device as set forth in claim 1, wherein the light-emitting element is an organic light-emitting diode.

16. A display device as set forth in claim 1, further comprising a pixel array substrate having a rectangular shape, a driving circuit for driving the second control line being mounted or monolithically provided near a corner of the rectangular shape of the pixel array substrate.

17. The display device as set forth in claim 16, wherein:

a driving circuit for driving the scanning line is mounted or monolithically provided so as to extend along one side of the rectangular shape of the pixel array substrate; and a driving circuit for driving the first control line is mounted or monolithically provided so as to extend along that side of the rectangular shape of the pixel array substrate which is opposite to the one side.

18. The display device as set forth in claim 16, wherein the driving circuit for driving the scanning line and the driving circuit for driving the first control line are mounted or monolithically provided so as to extend along one side of the rectangular shape of the pixel array substrate.

19. A method for driving a display device, the display device including:

a light-emitting element;

pixels, each of which is provided with first to fourth transistors and configured so that a control terminal of the first transistor is connected to a first control line, a control terminal of the fourth transistor is connected to a scanning line, a first electrically-conductive terminal of the fourth transistor is connected to a data line, a first electrically-conductive terminal of the second transistor is connected to a first power supply line via the first transistor, a control terminal of the second transistor is connected to the data line via the fourth transistor and to a terminal of the light-emitting element via a capacitor, and the terminal of the light-emitting element, a second electrically-conductive terminal of the second transistor, a first electrically-conductive terminal of the third transistor, and a control terminal of the third transistor are connected to each other; and a second control line shared commonly by at least two pixels among the pixels, the at least two pixels being such that the fourth transistors of the at least two pixels are connected to different scanning lines, and second electrically-conductive terminals of the third transistors of the at least two pixels are connected to the second control line, the method comprising the step of concurrently turning ON the third transistors of the at least two pixels, after sequentially turning OFF the first transistors of the at least two pixels.

* * * * *